US009159334B2

(12) United States Patent
Mukai et al.

(10) Patent No.: US 9,159,334 B2
(45) Date of Patent: Oct. 13, 2015

(54) VOICE PROCESSING DEVICE AND METHOD, AND PROGRAM

(75) Inventors: Akihiro Mukai, Chiba (JP); Akira Inoue, Toyko (JP)

(73) Assignee: Sony Corporation, Tokyo (JP)

( * ) Notice: Subject to any disclaimer, the term of this patent is extended or adjusted under 35 U.S.C. 154(b) by 665 days.

(21) Appl. No.: 13/416,117

(22) Filed: Mar. 9, 2012

(65) Prior Publication Data

US 2012/0239384 A1 Sep. 20, 2012

(30) Foreign Application Priority Data

Mar. 17, 2011 (JP) ..... 2011-058956

(51) Int. Cl.
*G10L 21/003* (2013.01)
*G10L 21/01* (2013.01)

(52) U.S. Cl.
CPC ..... *G10L 21/01* (2013.01)

(58) Field of Classification Search
CPC ..... G10L 21/00; G10L 21/003; G10L 21/01; G10L 21/013; G10L 21/04; G10L 21/043; G10L 21/045; G10L 21/047; G10L 13/033; G10L 13/0335
USPC ..... 704/200, 207, 211, 278, 503
See application file for complete search history.

(56) References Cited

U.S. PATENT DOCUMENTS

| | | | | |
|---|---|---|---|---|
| 6,763,329 | B2 * | 7/2004 | Brandel et al. | 704/207 |
| 6,975,987 | B1 * | 12/2005 | Tenpaku et al. | 704/258 |
| 2002/0101368 | A1 * | 8/2002 | Choi et al. | 341/61 |
| 2009/0074204 | A1 * | 3/2009 | Nakamura et al. | 381/98 |
| 2009/0144064 | A1 * | 6/2009 | Sakurai et al. | 704/503 |
| 2013/0325456 | A1 * | 12/2013 | Takagi et al. | 704/210 |

* cited by examiner

*Primary Examiner* — Qi Han
(74) *Attorney, Agent, or Firm* — Paratus Law Group, PLLC

(57) ABSTRACT

A voice processing device includes a voice pitch converting unit that performs a voice pitch converting process with respect to an input voice signal and converts voice pitch of the input voice signal, an error detecting unit that detects an error between the number of samples of an output voice signal, which is expected, and the number of samples of the output voice signal, which is actually output, and a time length control unit that controls adjustment of the time length in such a manner that the time length of the output voice signal is corrected by the amount of the error.

9 Claims, 21 Drawing Sheets

VOICE PROCESSING DEVICE AND METHOD, AND PROGRAM

BACKGROUND

The present disclosure relates to a voice processing device and a voice processing method, and a program, and particularly, to a voice processing device and a voice processing method, and a program, in which in the case of converting voice pitch of a voice signal, a variation in the expansion and contraction of an output voice may be suppressed.

Technologies of converting voice pitch in a voice signal of a voice or a musical composition have been used for a key control in a karaoke, a key change of a reference music for a musical instrument training, or the like in the related art. When one voice signal serving as a reference is prepared, a desired key may be obtained, and this also results in a memory saving, such that such a voice pitch converting process is a useful technology.

For example, as a method of converting voice pitch of a voice signal, a method in which a cycle of a voice waveform is changed by a sampling rate converter may be exemplified. In this method, the voice signal may be converted to a voice signal having a desired voice pitch, but the number of samples of the voice signal before and after the conversion varies.

Therefore, in general, as is expected in a voice pitch conversion processing device, to obtain the same number of samples of output data as that of input data, an adjustment with respect to the number of samples of output data is performed by a time expansion and contraction process such as PICOLA (Pointer Interval Controlled Overlap and Add) (for example, refer to "Morita, Itakura: voice expansion and contraction on a time axis using PICOLA (Pointer Interval Controlled OverLap and Add), and an evaluation thereof, collected papers of Acoustical Soc. of Japan, October 1986, pp. 149-150").

SUMMARY

However, in such a technology, in a case where the voice signal is subjected to the voice pitch conversion, a variation in the expansion and contraction of an output voice occurs, and therefore it is difficult to obtain voice with a high quality.

For example, in a case where the voice signal whose voice pitch is to be converted is subjected to a time expansion and contraction process such as PICOLA, a time length of the voice signal may be adjusted to a substantially expected length, but since the process is performed by pitch length or frame length as units, restrictions are imposed due to the process unit. Therefore, the time length of the voice signal may not be accurately converted to a time length that is expected, and the variation in the expansion and contraction may occur in the voice that is obtained through the voice pitch conversion.

In addition, in a case where the voice pitch conversion is performed by the sampling rate converter or the like, in the time expansion and contraction process with respect to the voice signal, the adjustment of the time length is performed by using the reciprocal of a time expansion and contraction ratio of the voice in the voice pitch conversion, but the reciprocal of the time expansion and contraction ratio does not necessarily become a rational number. In this manner, in a case where the reciprocal of the time expansion and contraction ratio does not become a rational number, an error may occur in the time expansion and contraction ratio that is used to the time expansion and contraction process, such that the time length of the voice signal may not be accurately converted to the expected time length.

It is desirable to suppress variation in the expansion and contraction of an output voice in the case of converting voice pitch of a voice signal.

According to an embodiment of the present disclosure, there is provided a voice processing device including a voice pitch converting unit that performs a voice pitch converting process with respect to an input voice signal and converts voice pitch of the input voice signal; an error detecting unit that detects an error between the number of samples of an output voice signal, which is expected, and the number of samples of the output voice signal, which is actually output; and a time length control unit that controls adjustment of the time length in such a manner that the time length of the output voice signal is corrected by the amount of the error.

The error detecting unit may detect the error based on the number of samples of the input voice signal, the number of samples of the output voice signal, which is output, and the number of non-processed samples of the input voice signal.

The voice processing device may further include a time expansion and contraction processing unit that performs a time expansion and contraction process with respect to the input voice signal, and adjusts the time length of the input voice signal.

The voice processing device may further includes a thinning and inserting unit that performs sample thinning or insertion with respect to the input voice signal to which the voice pitch converting process is performed, according to the control of the time length control unit, and adjusts the time length.

The voice processing device may further include a converting unit that performs a sampling rate conversion with respect to the input voice signal to which the voice pitch converting process is performed, according to the control of the time length control unit, and adjusts the time length.

The voice processing device may further include an overlap processing unit that performs an overlap process using a window with a length determined by the error with respect to the input voice signal to which the voice pitch converting process is performed, according to the control of the time length control unit, and adjusts the time length.

The voice processing device may further include a time expansion and contraction processing unit that performs a time expansion and contraction process with respect to the input voice signal with a time expansion and contraction ratio determined by the error, according to the control of the time length control unit, and adjusts the time length.

According to another embodiment of the present disclosure, there is provided a voice processing method or a program including performing a voice pitch converting process with respect to an input voice signal and converting voice pitch of the input voice signal; detecting an error between the number of samples of an output voice signal, which is expected, and the number of samples of the output voice signal, which is actually output; and controlling adjustment of the time length in such a manner that the time length of the output voice signal is corrected by the amount of the error.

According to the embodiments of the present disclosure, the voice pitch converting process is performed with respect to the input voice signal and the voice pitch of the input voice signal is converted; the error between the number of samples of the output voice signal, which is expected, and the number of samples of the output voice signal, which is actually output is detected; and the adjustment of the time length is controlled in such a manner that the time length of the output voice signal is corrected by the amount of the error.

According to the embodiments of the present disclosure, in the case of converting the voice pitch of the voice signal, a variation in the expansion and contraction of an output voice may be suppressed.

DETAILED DESCRIPTION OF EMBODIMENTS

Hereinafter, an embodiment to which the present technology is applied will be described with reference to drawings.

First Embodiment

Configuration Example of Voice Pitch Converting Device

Figure 1:
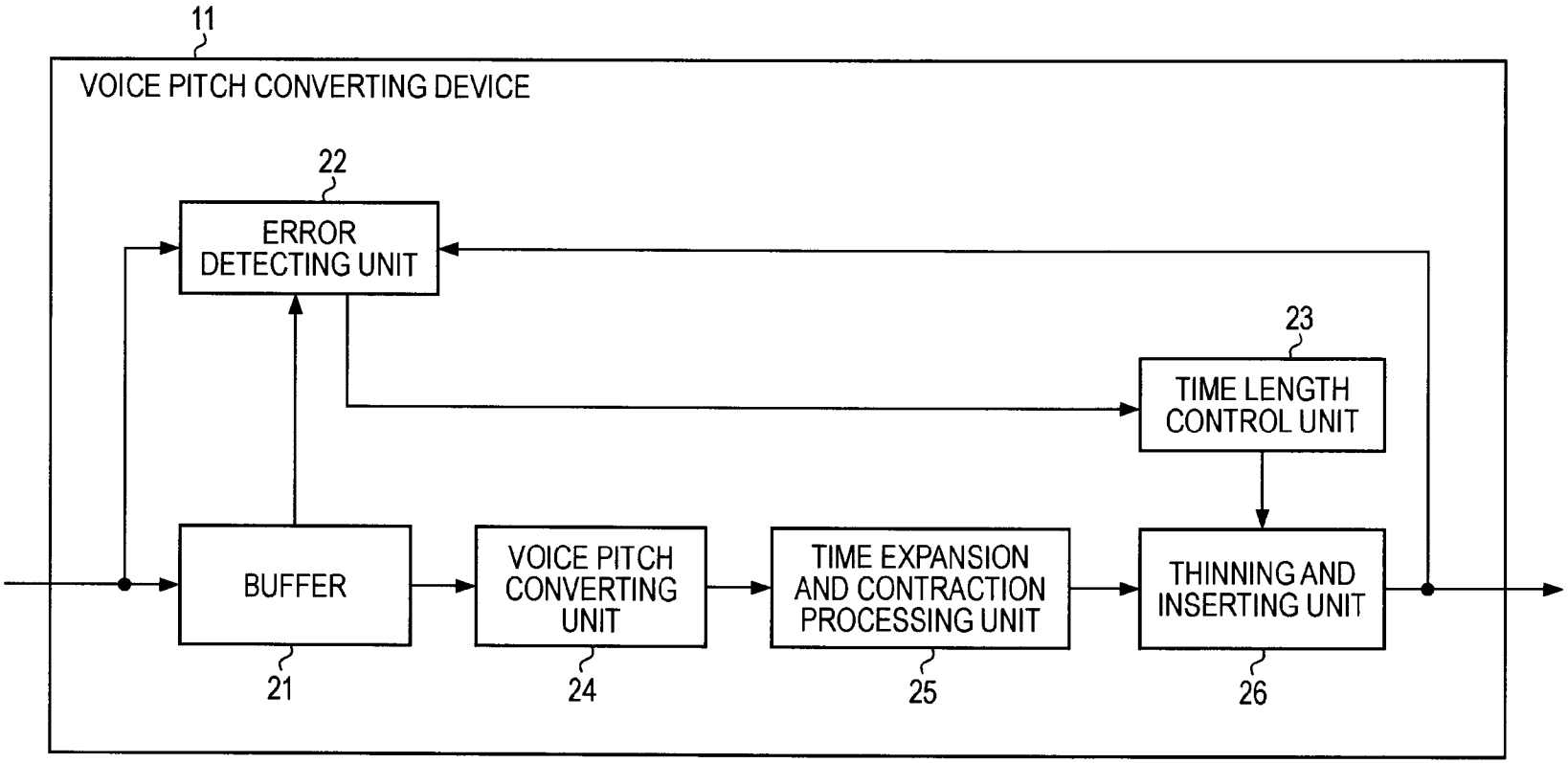
FIG. 1 is a diagram illustrating a configuration example of a voice pitch converting device according to a first embodiment.

FIG. 1 shows a configuration example of a voice pitch converting device according to a first embodiment to which the present technology is applied.

The voice pitch converting device 11 performs a voice pitch converting process with respect to an input voice signal, and outputs a voice signal in which voice pitch (height of the key of voice) is converted.

In addition, in the following description, the voice signal input to the voice pitch converting device 11 is also called an input voice signal, and the voice signal output from the voice pitch converting device 11 is also called an output voice signal. In addition, the voice signal that is an object to be subjected to the voice pitch converting process may be a signal of any voice such as a person's voice, a musical composition, or the like.

The voice pitch converting device 11 includes a buffer 21, an error detecting unit 22, a time length control unit 23, a voice pitch converting unit 24, a time expansion and contraction processing unit 25, and a thinning and inserting unit 26.

The buffer 21 temporarily stores an input voice signal that is input, and supplies it to the voice pitch converting unit 24. The error detecting unit 22 detects an error between the number of samples of the output voice signal, which is actually output, and the number of samples of the output voice signal, which is expected, based on an input voice signal that is input, a non-processed voice signal that is stored in the buffer 21, and an output voice signal supplied from the thinning and inserting unit 26. The error detecting unit 22 supplies the detected error to the time length control unit 23.

The time length control unit 23 performs a control of a time length adjustment of the voice signal based on the error supplied from the error detecting unit 22. That is, the time length control unit 23 gives an instruction of adjusting the time length of the voice signal, that is, the number of samples of the voice signal with respect to the thinning and inserting unit 26.

The voice pitch converting unit 24 performs a voice pitch converting process with respect to the voice signal that is read out from the buffer 21, and supplies the resultant voice signal to the time expansion and contraction processing unit 25. The time expansion and contraction processing unit 25 performs a time expansion and contraction process with respect to the voice signal that is supplied from the voice pitch converting unit 24, and expands and contracts a time length of the voice signal without changing a musical interval, and then supplies the resultant voice signal to the thinning and inserting unit 26.

The thinning and inserting unit 26 thins a sample of the voice signal that is supplied from the time expansion and contraction processing unit 25 or inserts a sample with respect to the voice signal, according to the control of the time length control unit 23, and thereby adjusts the time length of the voice signal. The thinning and inserting unit 26 outputs the output voice signal that is obtained by the adjustment of the time length with respect to the voice signal to the error detecting unit 22 and a subsequent stage (not shown).

Description of Voice Pitch Converting Process

However, when the input voice signal is supplied to the voice pitch converting device 11 and the voice pitch conversion instruction is given, the voice pitch converting device 11 performs the voice pitch converting process, and converts the input voice signal into the output voice signal that has the same number of samples and a different voice pitch, and then outputs the resultant voice signal.

Hereinafter, the voice pitch converting process by the voice pitch converting device 11 will be described with reference to a flowchart in FIG. 2.

In step S11, the buffer 21 temporarily stores the input voice signal that is input.

In step S12, the error detecting unit 22 calculates the error of the number of samples of the output voice signal based on the input voice signal that is input, the input voice signal that is stored in the buffer 21, and the output voice signal that is supplied from the thinning and inserting unit 26.

For example, the error detecting unit 22 calculates an error ER of the number of samples of the output voice signal by calculating the following equation (1) in a state in which the number of samples of the input voice signal that is input is set to N1, the number of samples of the input voice signal that is stored in the buffer 21 is set to N2, and the number of samples of the output voice signal is set to N3.

$$\text{Error } ER = N3 - (N1 - N2) \quad (1)$$

In addition, in equation (1), the number of samples N1 of the input voice signal, and the number of samples N3 of the output voice signal are set to the number of samples from predetermined positions (samples), for example, the number of samples from the front samples of the voice signal that is an object to be processed, or the like.

In the case of converting the voice pitch, it is preferable that the number of the total samples of the output voice signal, which is actually output, and the number of the total samples of the input voice signal be the same as each other, in order for a variation in the expansion and contraction not to occur in the output voice signal that can be obtained in the conversion. Therefore, the error detecting unit 22 calculates a difference in the number of the samples of the output voice signal at a current point of time, and the number of samples of the input voice signal that is actually processed, as the error ER.

Here, each sample of the input voice signal is sequentially read out from the buffer 21, and is processed by the voice pitch converting unit 24, such that a sample not processed yet presents in the input voice signal that is input to the voice pitch converting device 11. Such a non-processed sample is a sample that is stored in the buffer 21, such that when a difference between the number of samples N1 of the input voice signal, and the number of samples N2 of the voice signal that is stored in the buffer 21 is obtained, the number of samples that are actually process may be obtained.

Therefore, when the number of samples (N1-N2) that are actually processed, and the number of samples N3 of the output voice signal, which is actually output, are the same as each other, that is, when the error ER is zero, the variation in expansion and the contraction in the output voice signal does not occur.

The number of samples N1 of the input voice signal, the number of samples N2 of the voice signal of the buffer 21, and the number of samples N3 of the output voice signal may be grasped with accuracy by the error detecting unit 22, and these numbers becomes zero or a positive integer. Therefore, the error detecting unit 22 may calculate the error ER with accuracy through the calculation of equation (1) from the above-described zero or positive integer without depending on calculation accuracy in the error detecting unit 22.

When the error detecting unit 22 supplies the calculated error ER to the time length control unit 23, the process proceeds from step S12 to step S13.

In step S13, the time length control unit 23 performs a control of the time length adjustment of the voice signal based on the error ER supplied from the error detecting unit 22.

For example, in a case where the error ER is a positive value, the time length control unit 23 gives an instruction of thinning samples from the voice signal with respect to the thinning and inserting unit 26, and in a case where the error ER is a negative value, the time length control unit 23 gives an instruction of inserting samples to the voice signal with respect to the thinning and inserting unit 26. In a case where the error ER is zero, the time length control unit 23 suppresses the execution of the process in the thinning and inserting unit 26.

In step S14, the voice pitch converting unit 24 performs reads out a predetermined amount of voice signal from the buffer 21, and performs a voice pitch converting process with respect to the read out voice signal, and then supplies the voice signal in which the voice pitch is converted to the time expansion and contraction processing unit 25. For example, a voice signal is read out frame by frame from the buffer 21 and is processed.

In addition, the voice pitch converting unit 24 performs, for example, a sampling rate conversion with respect to the voice signal, and makes a cycle of the voice waveform of the voice signal long or short to convert the voice pitch of the voice signal to a desired height. In addition, the voice pitch conversion of the voice signal may be realized by another method such as PSOLA (Pitch Synchronous Overlap Add).

In step S15, the time expansion and contraction processing unit 25 performs the time expansion and contraction process, for example, the PICOLA, a phase vocoder, or the like with respect to the voice signal that is supplied from the voice pitch converting unit 24, and supplies the voice signal that can be obtained from the result thereof to the thinning and inserting unit 26.

For example, in the time expansion and contraction process, the reciprocal of the expansion and contraction ratio of the time length of the voice signal, which is changed by the voice pitch converting process performed by the voice pitch converting unit 24, is set as the time expansion and contraction ratio, and the time length of the voice signal is adjusted by the time expansion and contraction ratio. Therefore, the number of samples of the voice signal increases and decreases in such a manner that the number of samples of the voice signal, which increases and decreases through the voice pitch conversion by the voice pitch converting unit 24, becomes substantially the same number of samples before the voice pitch conversion.

In step S16, the thinning and inserting unit 26 performs sample thinning or inserting of the voice signal supplied from the time expansion and contraction processing unit 25, according to a control of the time length control unit 23, and generates the output voice signal.

For example, in a case where the error ER is a positive value, the thinning and inserting unit 26 thins (deletes) a sample from the voice signal by a number indicated by the error ER. In addition, in a case where a plurality of samples are thinned from the voice signal, a plurality of samples of the voice signal, which are parallel with each other in succession, may be thinned, or each sample from several positions of the voice signal may be thinned.

In addition, the error ER is a negative value, the thinning and inserting unit 26 inserts a sample to a predetermined position of the voice signal by a number indicated by the error ER. Here, a sample value of the sample inserted to the voice signal may be set to have the same sample value as a sample that is located immediately before or after a sample to be inserted, or may be set to a value such as zero that is determined in advance.

In addition, in a case where a plurality of samples are inserted to the voice signal, a plurality of samples may be inserted in succession in one section of the voice signal, or each sample may be inserted to each of several positions of the voice signal.

In addition, in a case where the error ER is zero, the thinning and inserting unit 26 sets the voice signal supplied from the time expansion and contraction processing unit 25 as the output voice signal as it is, without performing neither the sample thinning nor the sample inserting with respect to the voice signal.

When the output voice signal is generated, the thinning and inserting unit 26 supplies the generated output voice signal to the error detecting unit 22, and outputs the output voice signal to a reproduction unit or the like that is located at a subsequent stage.

In this manner, in the thinning and inserting unit 26, the sample is deleted from or inserted to the voice signal by the amount of the error ER to correct the number of samples of the voice signal, and thereby the number of the samples of the output voice signal may be the number of samples that is expected (anticipated). That is, a minute adjustment of the number of sample, which may not be performed in the time expansion and contraction processing unit 25, is performed, and thereby the number of samples of the output voice signal may be the same number of samples of the input voice signal.

In step S17, the voice pitch converting device 11 determines whether or not the process is to be terminated. For example, in a case where all of the samples of the input voice signal that is supplied are processed, the voice pitch converting device 11 determines that the process is to be terminated.

In step S17, in a case where it is determined that the process is not to be terminated, the process returns to step S11, and the above-described processes are repeated. On the contrary, in step S17, in a case where it is determined that the process is to be terminated, the voice pitch converting process is terminated.

In this manner, the voice pitch converting device 11 calculates the error between the number of samples of the output voice signal, which is expected to be output, and the number of samples of the output voice signal, which is actually output, and increases and decreases the number of samples of the voice signal in response to the error.

Therefore, the number of samples of the output voice signal may become the expected number of samples. Particularly, since in the voice pitch converting device 11, the correction to the number of samples of the output voice signal, which is expected, is performed at all times while performing the voice pitch converting process, the variation in the expansion and contraction of the output voice may be suppressed.

First Modification

Configuration Example of Voice Pitch Converting Device

Figure 3:
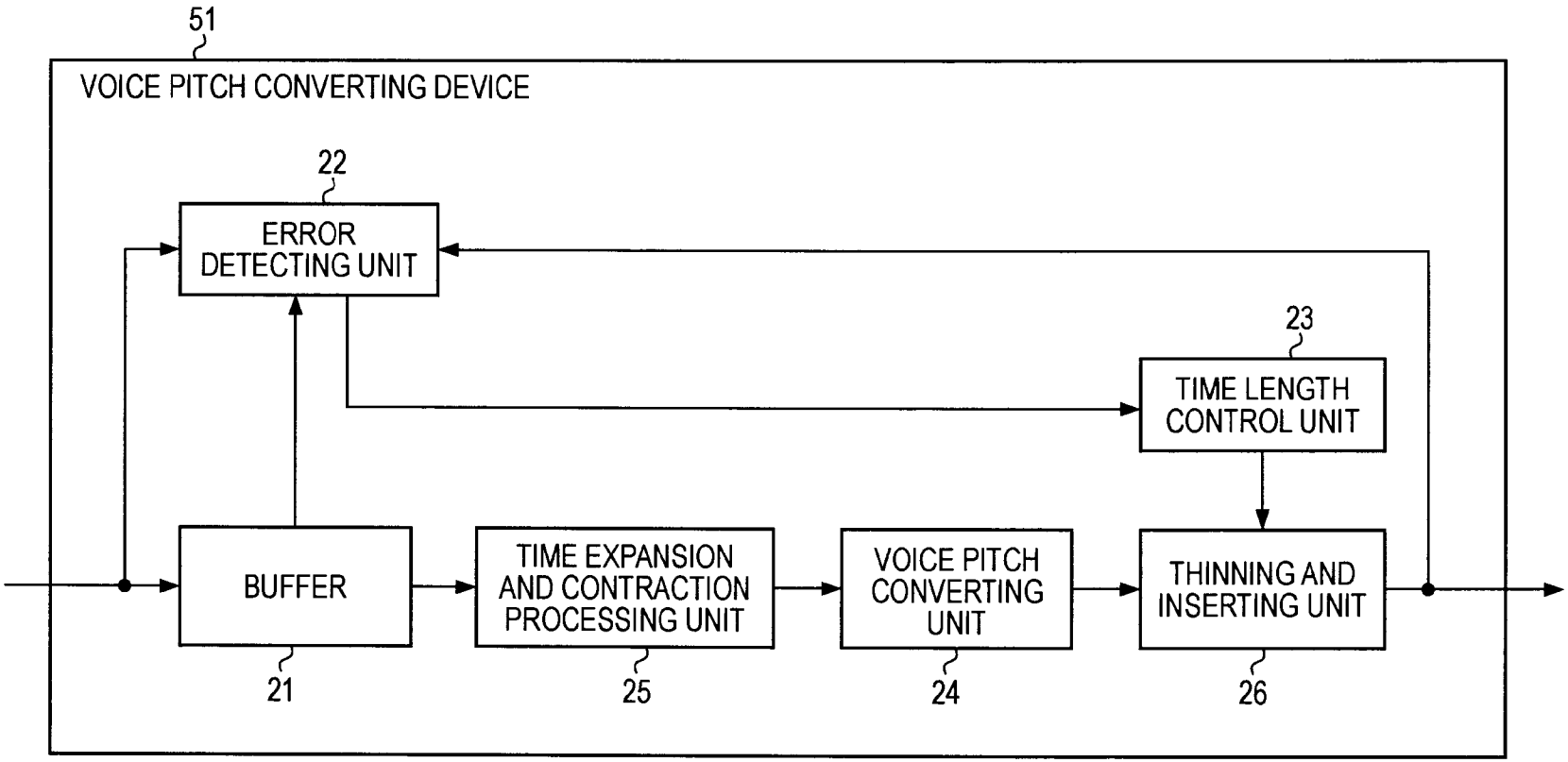
FIG. 3 is a diagram illustrating another configuration example of the voice pitch converting device.

In addition, description has been made with respect to a case in which the time expansion and contraction process is performed after performing the voice pitch converting process, but the voice pitch converting process may be performed after the time expansion and contraction process. In this case, the voice pitch converting device may be configured, for example, as shown in FIG. 3. In addition, in FIG. 3, like reference numerals will be given to parts corresponding to those in the case of FIG. 1, and description thereof will be appropriately omitted.

A voice pitch converting device 51 in FIG. 3 includes the buffer 21 to the thinning and inserting unit 26. The voice pitch converting device 51 and the voice pitch converting device 11 in FIG. 1 are different from each other in a connection relationship between the voice pitch converting unit 24 and the time expansion and contraction processing unit 25, and the other configurations are the same as each other.

That is, in the voice pitch converting device 51, the time expansion and contraction processing unit 25 performs the time expansion and contraction process with respect to the voice signal read out from the buffer 21, and supplies the resultant voice signal to the voice pitch converting unit 24. In addition, the voice pitch converting unit 24 performs the voice pitch converting process with respect to the voice signal supplied from the time expansion and contraction processing unit 25, and supplies the resultant voice signal to the thinning and inserting unit 26.

Description of Voice Pitch Converting Process

Figure 4:
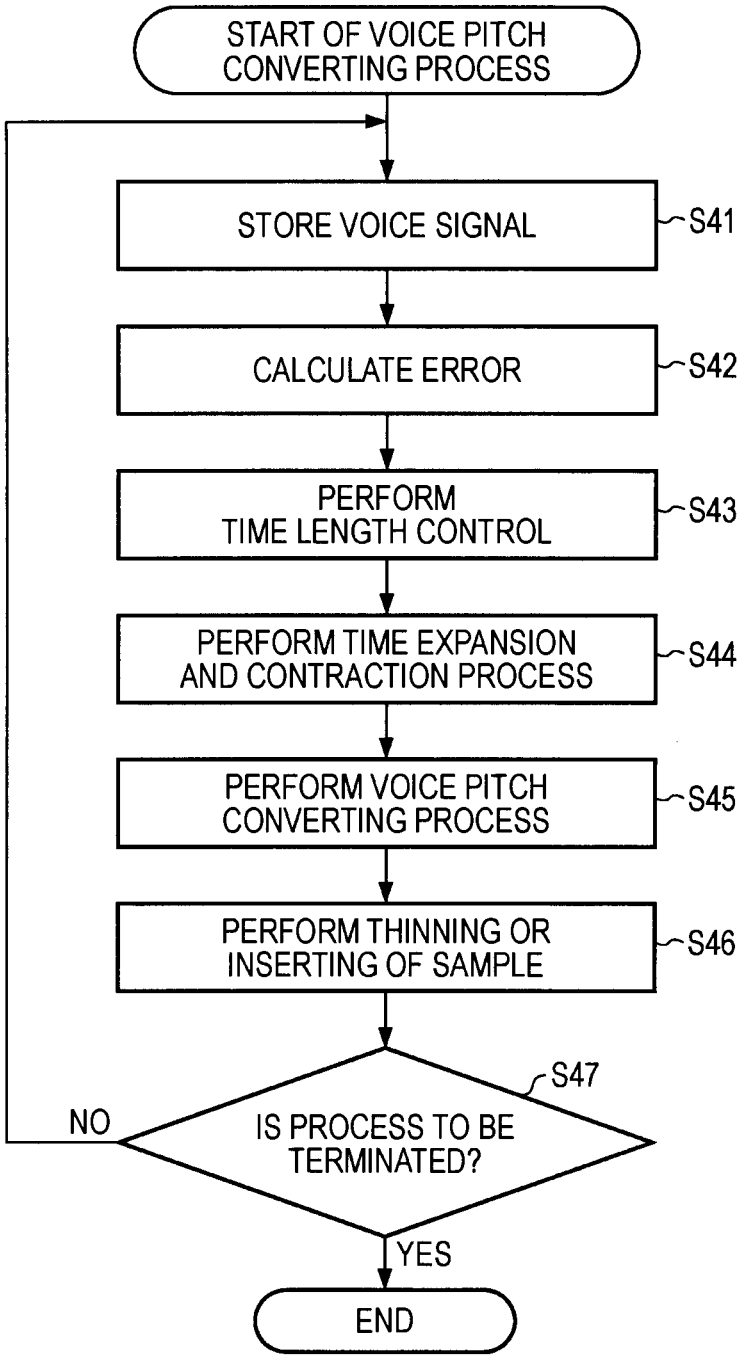
FIG. 4 is a flowchart illustrating the voice pitch converting process.

Next, the voice pitch converting process performed by the voice pitch converting device 51 in FIG. 3 will be described with reference a flowchart in FIG. 4. In addition, the processes in step S41 to step S43 are the same as those in step S11 to step S13 in FIG. 2, such that description thereof will be omitted.

In step S44, the time expansion and contraction processing unit 25 reads out the voice signal from the buffer 21 and performs the time expansion and contraction process, and then supplies the resultant voice signal to the voice pitch converting unit 24. In step S45, the voice pitch converting unit 24 performs the voice pitch converting process with respect to the voice signal supplied from the time expansion and contraction processing unit 25, and supplies the resultant voice signal to the thinning and inserting unit 26. In addition, in step S44 and step S45, the same processes as those in step S15 and step S14 in FIG. 2 are performed.

Figure 2:
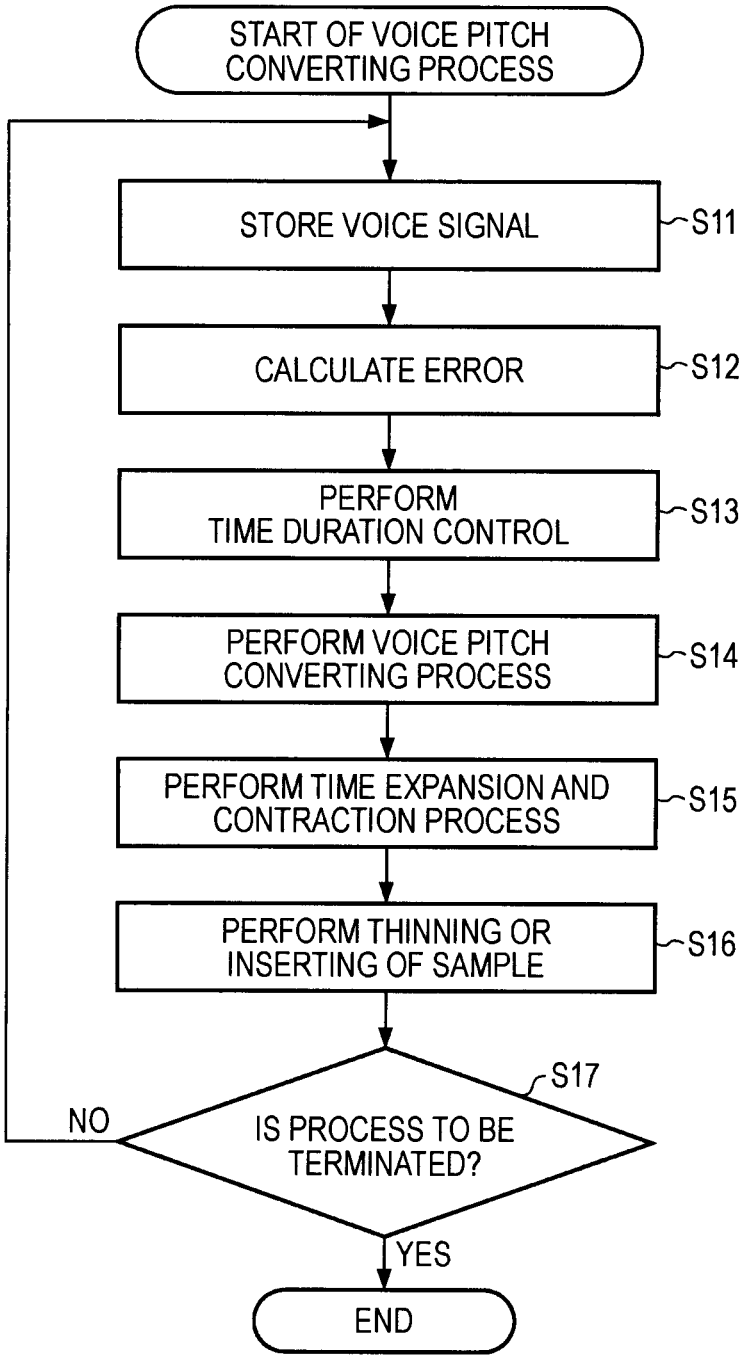
FIG. 2 is a flowchart illustrating a voice pitch converting process.

Processes in step S46 and step S47 are performed after the process in step S45 is performed, and then the voice pitch converting process is terminated, but these processes are the same as those in step S16 and step S17 of FIG. 2, such that description thereof will be omitted.

In this manner, even when the voice pitch converting process is performed after the time expansion and contraction process, the variation in the expansion and contraction of the output voice may be suppressed.

Second Embodiment

Configuration Example of Voice Pitch Converting Device

In addition, description has been made with respect to a case in which the correction of the number of samples by the amount of the error ER is performed by either the sample thinning or the sample inserting, but the correction by the amount of the error ER may be performed by the sampling rate conversion process.

Figure 5:
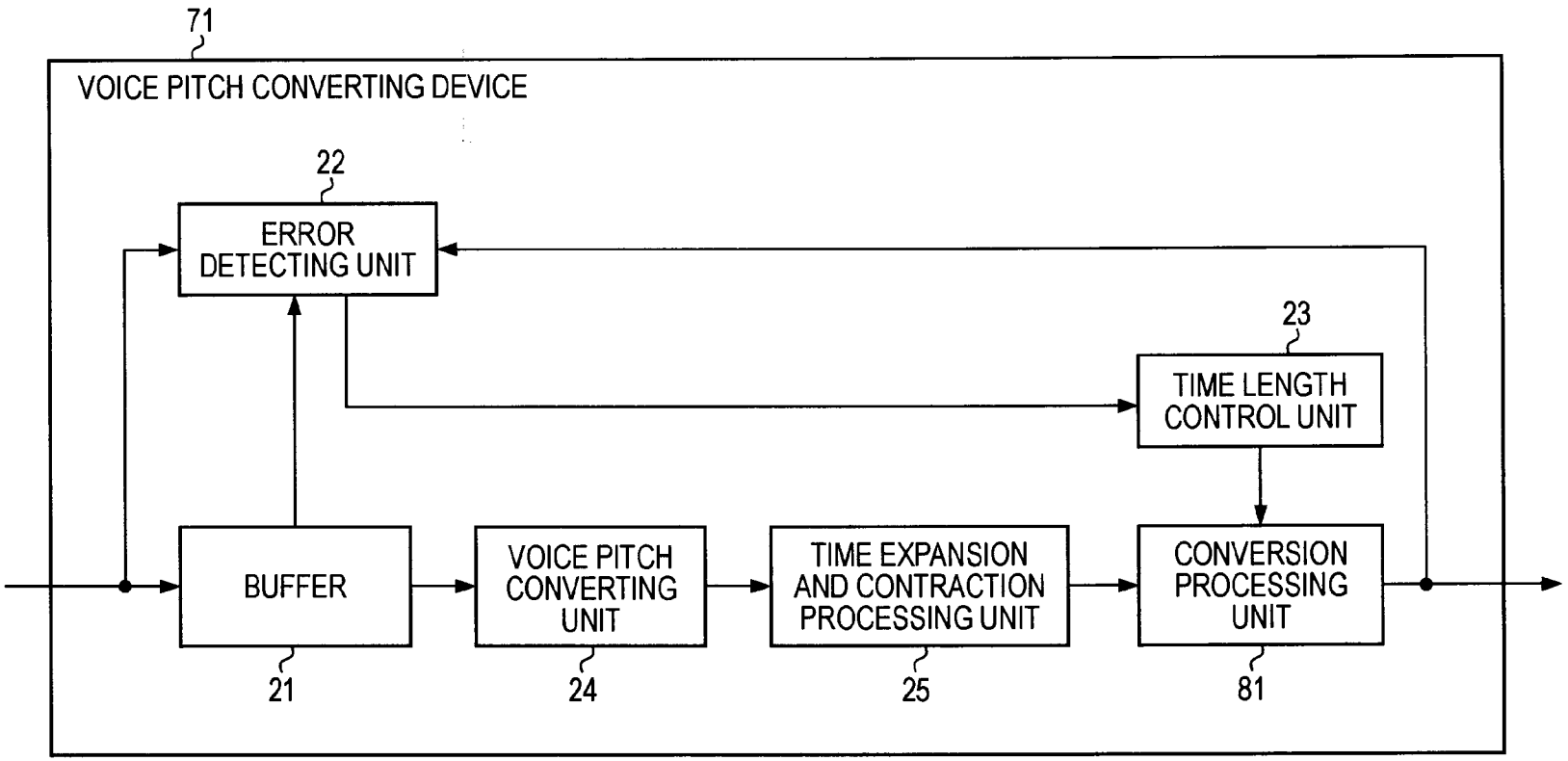
FIG. 5 is a diagram illustrating still another configuration example of the voice pitch converting device.

In this case, the voice pitch converting device may be configured, for example, as shown in FIG. 5. In addition, in FIG. 5, like reference numerals will be given to parts corresponding to those in the case of FIG. 1, and description thereof will be appropriately omitted. A voice pitch converting device 71 in FIG. 5 and the voice pitch converting device 11 in FIG. 1 are different from each other in that the voice pitch converting device 71 is provided with a conversion processing unit 81 instead of the thinning and inserting unit 26 of the voice pitch converting device 11, and the other configurations are the same as each other.

The conversion processing unit 81 performs a sampling rate converting process with respect to the voice signal supplied from the time expansion and contraction processing unit 25, according to the control of the time length control unit 23, and adjusts the time length of the voice signal. The conversion processing unit 81 outputs the output voice signal that can be obtained through the adjustment of the time length with respect to the voice signal to the error detecting unit 22 and a subsequent stage (not shown).

Description of Voice Pitch Converting Process

Next, the voice pitch converting process performed by the voice pitch converting device 71 will be described with reference a flowchart in FIG. 6. In addition, the processes in step S71 to step S75 are the same as those in step S11 to step S15 in FIG. 2, such that description thereof will be omitted.

In step S76, the conversion processing unit 81 performs the sampling rate conversion with respect to the voice signal supplied from the time expansion and contraction processing unit 25, according to a control of the time length control unit 23, and converts the sampling rate of the voice signal.

For example, in a case where the error ER is a positive value, the conversion processing unit 81 performs a downsampling with respect to the voice signal with a conversion ratio determined by the error ER so that the sample is deleted from the voice signal as much as a number indicated by the error ER.

In addition, in a case where the error ER is a negative value, the conversion processing unit 81 performs an up-sampling with respect to the voice signal with a conversion ratio determined by the error ER so that the sample is inserted to the voice signal as much as a number indicated by the error ER.

In this manner, as the sampling rate converting process, the down-sampling or the up-sampling is performed in response to the error ER, such that the number of samples of the voice signal increases or decreases through interpolation or the like, and thereby the number of samples of the output voice signal may become the number of samples that is expected.

In addition, in a case where the error ER is zero, the conversion processing unit 81 does not perform the sampling rate converting process with respect to the voice signal, and outputs the voice signal supplied from the time expansion and contraction processing unit 25 as the output voice signal as it is.

When the output voice signal is generated, the conversion processing unit 81 supplies the generated output voice signal to the error detecting unit 22, and outputs the output voice signal to a reproduction unit or the like, which is located at a subsequent stage.

A process in step S77 is performed after the process in step S76 is performed, and then the voice pitch converting process is terminated, but the process in step S77 is the same as that in step S17 of FIG. 2, such that description thereof will be omitted.

In this manner, the voice pitch converting device 71 calculates the error between the number of samples of the output voice signal, which is expected to be output, and the number of samples of the output voice signal, which is actually output, and converts the sampling rate of the voice signal in response to the error, and thereby increases or decreases the number of samples of the voice signal. As a result, the number of samples of the output voice signal may become the expected number of samples, and thereby the variation in the expansion and contraction of the output voice may be suppressed.

Second Modification

Configuration Example of Voice Pitch Converting Device

Figure 7:
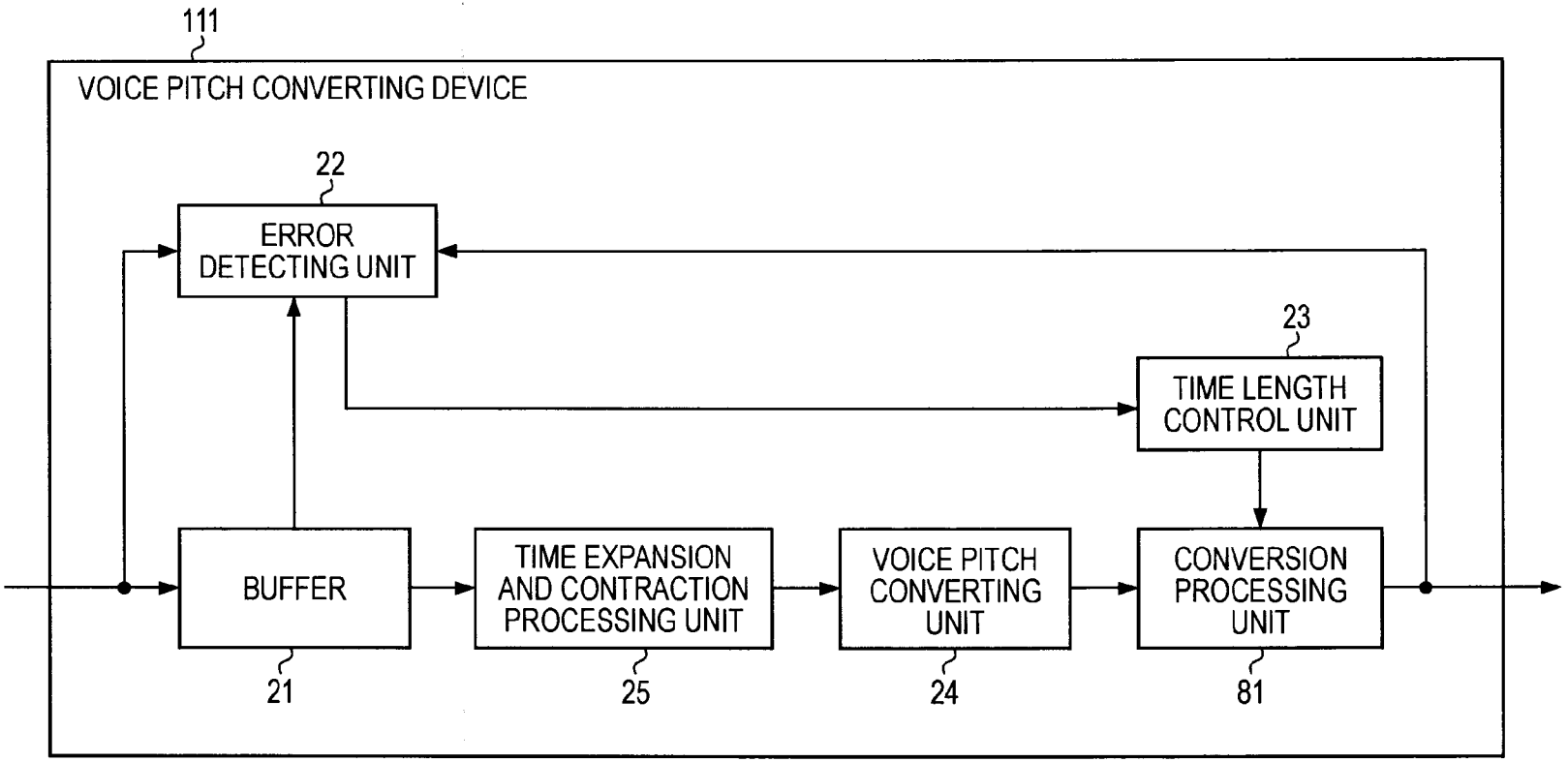
FIG. 7 is a diagram illustrating still another configuration example of the voice pitch converting device.

In addition, in the case of performing the sampling rate converting process in response to the error ER, the voice pitch converting process may be performed after the time expansion and contraction process. In this case, the voice pitch converting device may be configured, for example, as shown in FIG. 7. In addition, in FIG. 7, like reference numerals will be given to parts corresponding to those in the case of FIG. 5, and description thereof will be appropriately omitted.

The voice pitch converting device 111 in FIG. 7 and the voice pitch converting device 71 in FIG. 5 are different from each other in a connection relationship between the voice pitch converting unit 24 and the time expansion and contraction processing unit 25 is reversed, and the other configurations are the same as each other.

That is, in the voice pitch converting device 111, the time expansion and contraction processing unit 25 performs the time expansion and contraction process with respect to the voice signal read out from the buffer 21, and the voice pitch converting unit 24 performs the voice pitch converting process with respect to the voice signal supplied from the time expansion and contraction processing unit 25, and supplies the resultant voice signal to the conversion processing unit 81.

Description of Voice Pitch Converting Process

Figure 8:
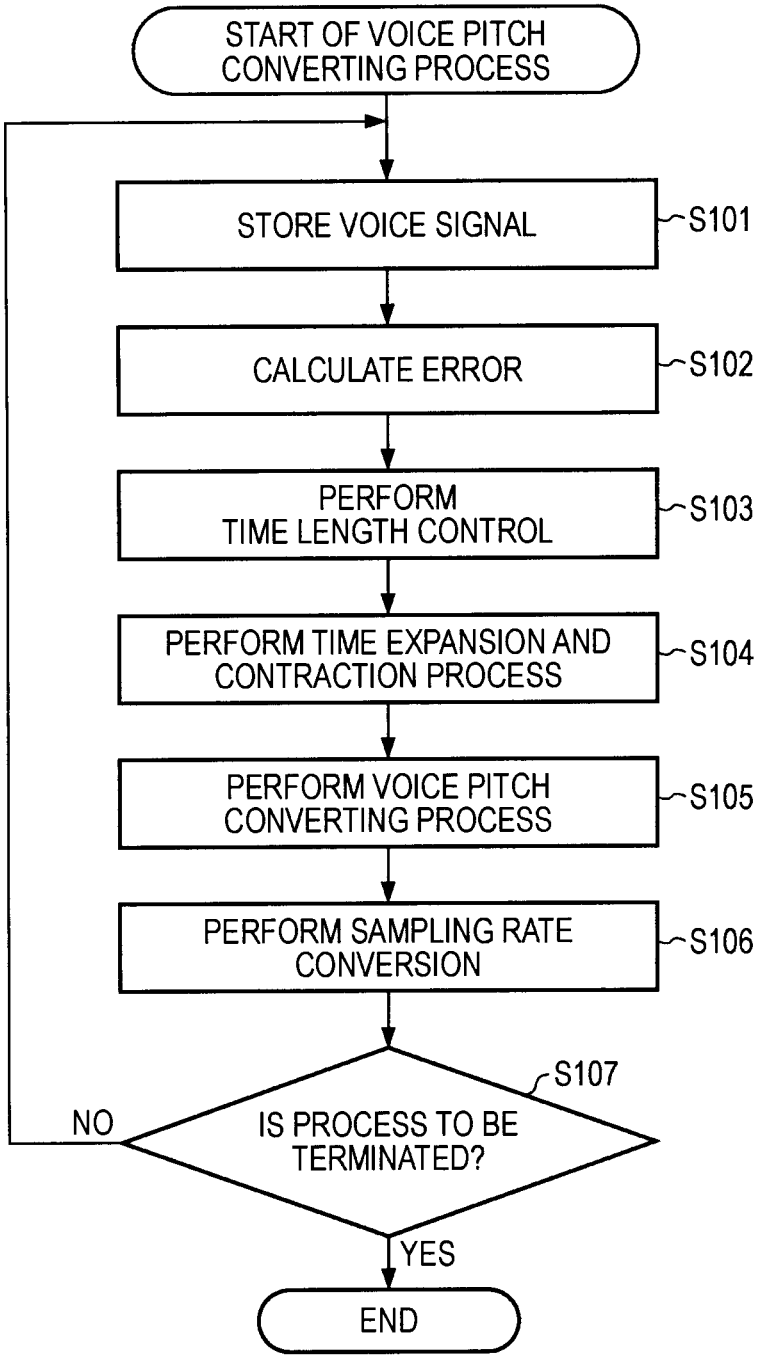
FIG. 8 is a flowchart illustrating the voice pitch converting process.

Next, the voice pitch converting process performed by the voice pitch converting device 111 in FIG. 7 will be described with reference a flowchart in FIG. 8. In addition, the processes in step S101 to step S103 are the same as those in step S71 to step S73 in FIG. 6, such that description thereof will be omitted.

In step S104, the time expansion and contraction processing unit 25 reads out the voice signal from the buffer 21 and performs the time expansion and contraction process, and then supplies the resultant voice signal to the voice pitch converting unit 24. In step S105, the voice pitch converting unit 24 performs the voice pitch converting process with respect to the voice signal supplied from the time expansion and contraction processing unit 25, and supplies the resultant voice signal to the conversion processing unit 81. In addition, in step S104 and step S105, the same processes as those in step S75 and step S74 in FIG. 6 are performed.

Figure 6:
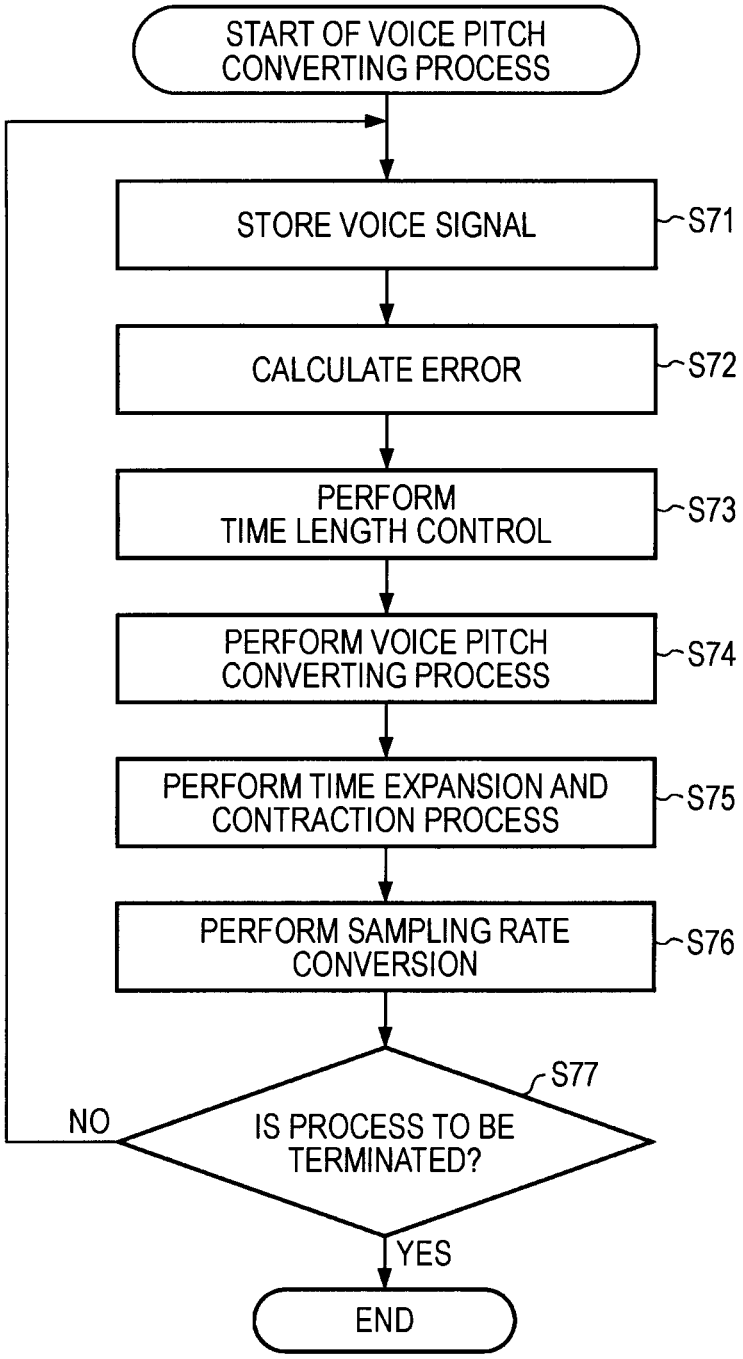
FIG. 6 is a flowchart illustrating the voice pitch converting process.

Processes in step S106 and step S107 are performed after the process in step S105 is performed, and then the voice pitch converting process is terminated, but these processes are the same as those in step S76 and step S77 of FIG. 6, such that description thereof will be omitted.

In this manner, even when the voice pitch converting process is performed after the time expansion and contraction process, the variation in the expansion and contraction of the output voice may be suppressed.

Third Embodiment

Configuration Example of Voice Pitch Converting Device

In addition, description has been made with respect to an example in which the correction by the amount of the error ER is performed by the sampling rate converting process, but the correction by the amount of the error ER may be performed through an overlap process by a window framing.

Figure 9:
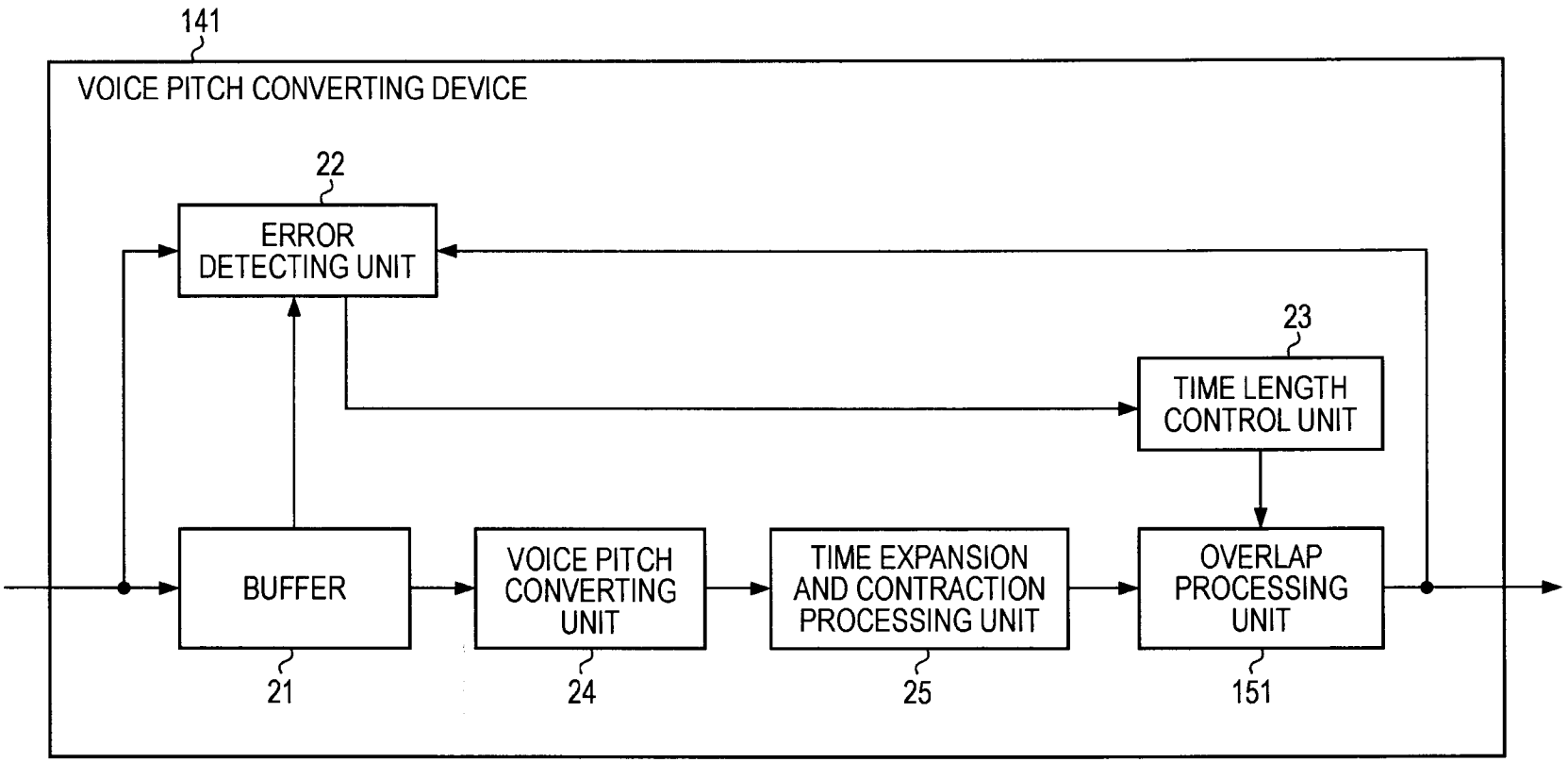
FIG. 9 is a diagram illustrating still another configuration example of the voice pitch converting device.

In this case, the voice pitch converting device may be configured, for example, as shown in FIG. 9. In addition, in FIG. 9, like reference numerals will be given to parts corresponding to those in the case of FIG. 1, and description thereof will be appropriately omitted. A voice pitch converting device 141 in FIG. 9 and the voice pitch converting device 11 in FIG. 1 are different from each other in that the voice pitch converting device 141 is provided with an overlap processing unit 151 instead of the thinning and inserting unit 26 of the voice pitch converting device 11, and the other configurations are the same as each other.

The overlap processing unit 151 performs the overlap process by the window framing with respect to the voice signal supplied from the time expansion and contraction processing unit 25, according to a control of the time length control unit 23, and thereby adjusts the time length of the voice signal. The overlap processing unit 151 outputs the output voice signal that can be obtained by the adjustment of the time length with respect to the voice signal to the error detecting unit 22 and a subsequent stage (not shown).

Description of Voice Pitch Converting Process

Next, the voice pitch converting process performed by the voice pitch converting device 141 will be described with reference a flowchart in FIG. 10. In addition, the processes in step S131 to step S135 are the same as those in step S11 to step S15 in FIG. 2, such that description thereof will be omitted.

In step S136, the overlap processing unit 151 performs the overlap process with respect to the voice signal supplied from the time expansion and contraction processing unit 25, according to a control of the time length control unit 23, and increases or decreases the number of samples of the voice signal.

For example, in a case where the error ER is a positive value, the overlap processing unit 151 performs the overlap process with respect to the voice signal by the window framing with a length (hereinafter, referred to as a window frame length) of the number of samples by the amount of the error ER. Therefore, for example, a section with a length two times the window frame length of the voice signal is converted to a section with a length of the window frame length, and thereby the adjustment of the number of samples is performed. That is, the sample of the voice signal is reduced as much as the length of the window frame length (error ER).

In addition, in a case where the error ER is a negative value, the overlap processing unit 151 performs the overlap process with respect to the voice signal by a window framing with a length of the number of samples by the amount of the error ER. Therefore, for example, a section with a length two times the window frame length of the voice signal is converted to a section with a length three times the window frame length, and thereby the adjustment of the number of samples is performed. That is, the number of samples of the voice signal increases as much as the length of the window frame length (error ER).

In addition, in a case where the error ER is zero, the overlap processing unit 151 sets the voice signal supplied from the time expansion and contraction processing unit 25 as the output voice signal as it is, without performing the overlap process with respect to the voice signal.

In addition, the window used in the overlap process may be a window having any shape, for example, a triangular window, a rectangular window, a hanning window, a sin window, a cos window, or the like.

Figure 11:
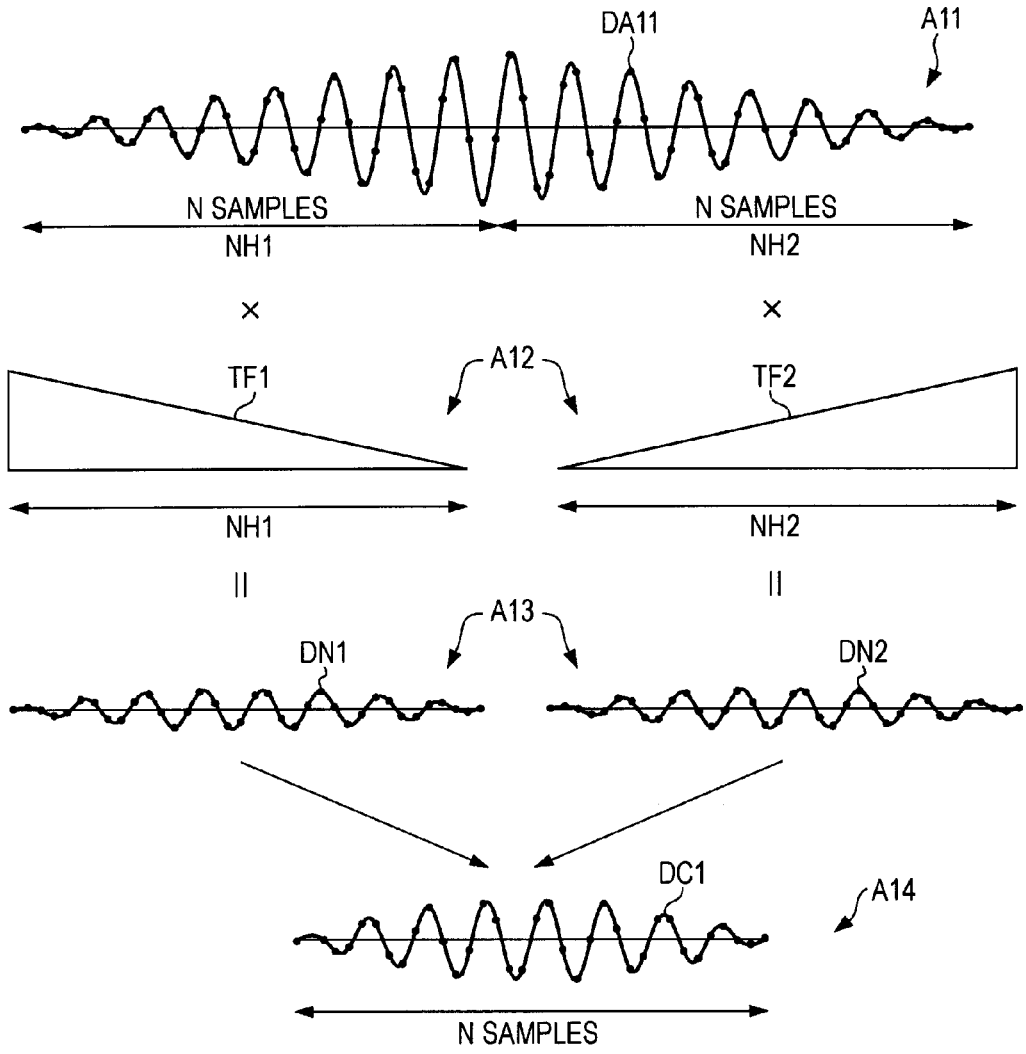
FIG. 11 is a diagram illustrating an overlap process.

For example, in a case where the error ER is a positive value, and the triangular window is used in the overlap process, as shown in FIG. 11, a voice signal DA11 is contracted in a time direction. In addition, in FIG. 11, the horizontal direction represents a time, and the vertical direction represents a magnitude of a signal or a function. In addition, in the drawing, circles on a waveform of the voice signal represent samples.

In FIG. 11, as indicated by an arrow A11, it is assumed that the voice signal DA11 is supplied from the time expansion and contraction processing unit 25 to the overlap processing unit 151. In addition, it is assumed that the overlap processing unit 151 contracts a section including a section NH1 and a section NH2 of the voice signal DA11 to a section with a half of the number of the samples. In addition, the section NH1 and the section NH2 are sections with a length of the window frame length, which include N samples of the voice signal DA11.

In this case, the window framing by a triangular window TF1 and a triangular window TF2 is performed with respect to the section NH1 and the section NH2 of the voice signal DA11, as indicated by an arrow Al2.

Here, the triangular window TF1 is a window function indicating a weight that is multiplied to each sample in the section NH1, and the magnitude of the weight becomes small, as it goes toward a weight multiplied to a sample within the section NH1, which is located at a right side in the drawing. The magnitude of the weight of the triangular window TF1 linearly decreases in a time direction (in a future direction).

In addition, a triangular window TF2 is a window function indicating a weight that is multiplied to each sample in the section NH2, and the magnitude of the weight becomes large, as it goes toward a weight multiplied to a sample within the section NH2, which is located at a right side in the drawing. The magnitude of the weight of the triangular window TF2 linearly increases in a time direction (in a future direction).

When the window framing using the triangular window TF1 and the triangular window TF2 is performed, a signal DN1 and a signal DN2 that are indicated by an arrow A13 may be obtained. That is, to each sample within the section NH1 of the voice signal DA11, a value of the triangular window TF1, which is located at the same position as the sample, is multiplied as the weight, and thereby the signal DN1 is obtained. Similarly, to each sample within the section NH2 of the voice signal DA11, a value of the triangular window TF2, which is located at the same position as the sample, is multiplied as the weight, and thereby the signal DN2 is obtained.

In addition, samples, which are located at the same position as each other, of the signal DN1 and the signal DN2 are added to each other, and thereby a signal DC1 indicated by an arrow A14 is generated. In this manner, the signal DC1, which includes N samples that can be obtained by synthesizing the signal DN1 and the signal DN2, is inserted a section including the section NH1 and the section NH2 of the voice signal DA11, and signal obtained as a result thereof becomes a voice signal after the overlap process. That is, the signal in the section including the section NH1 and the section NH2 of the voice signal DA11 may be substituted with a signal DC1, and thereby the voice signal DA11 is contracted as much as N samples.

Figure 12:
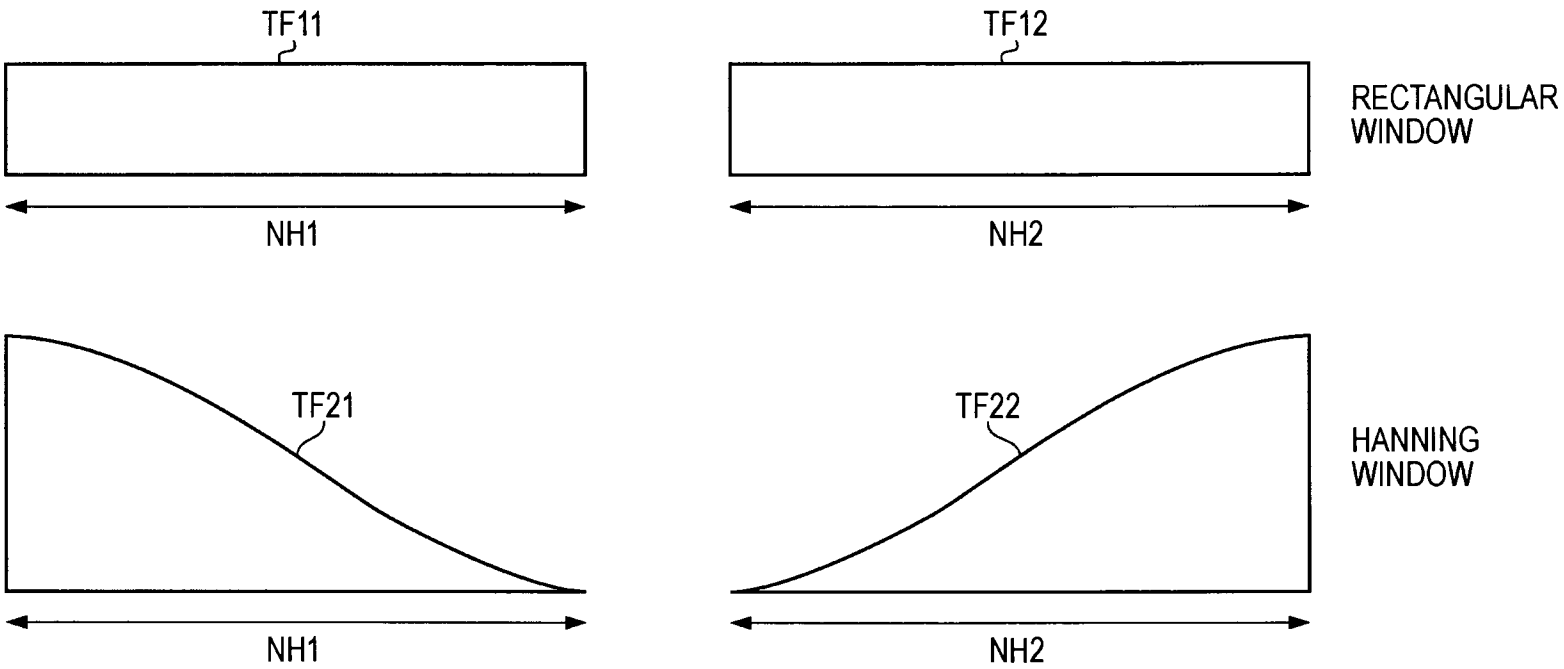
FIG. 12 is a diagram illustrating an example of a window function.

In addition, in the case of contracting the voice signal DA11, for example, a window shown in FIG. 12 may be used. That is, as shown at an upper side in the drawing, a window framing by a rectangular window TF11 and a rectangular window TF12 may be performed with respect to the section NH1 and the section NH2 of the voice signal DA11. Here, the rectangular window TF11 and the rectangular window TF12 are window functions in which a weight multiplied to each sample has the same value in each case.

In addition, as shown at a lower side in the drawing, a window framing by a hanning window TF21 and a hanning window TF22 may be performed with respect to the section NH1 and the section NH2 of the voice signal DA11.

Here, the hanning window TF21 is a window function that represents a weight that is multiplied to each sample within the section NH1, and a magnitude of the weight decreases, as it goes toward a weight multiplied to a sample located at a future direction side within the section NH1. In addition, the hanning window TF22 is a window function that represents a weight that is multiplied to each sample within the section NH2, and a magnitude of the weight increases, as it goes toward a weight multiplied to a sample located at a future direction side within the section NH2. A value (weight) of the hanning window TF21 and the hanning window TF22 non-linearly varies in the time direction.

Figure 13:
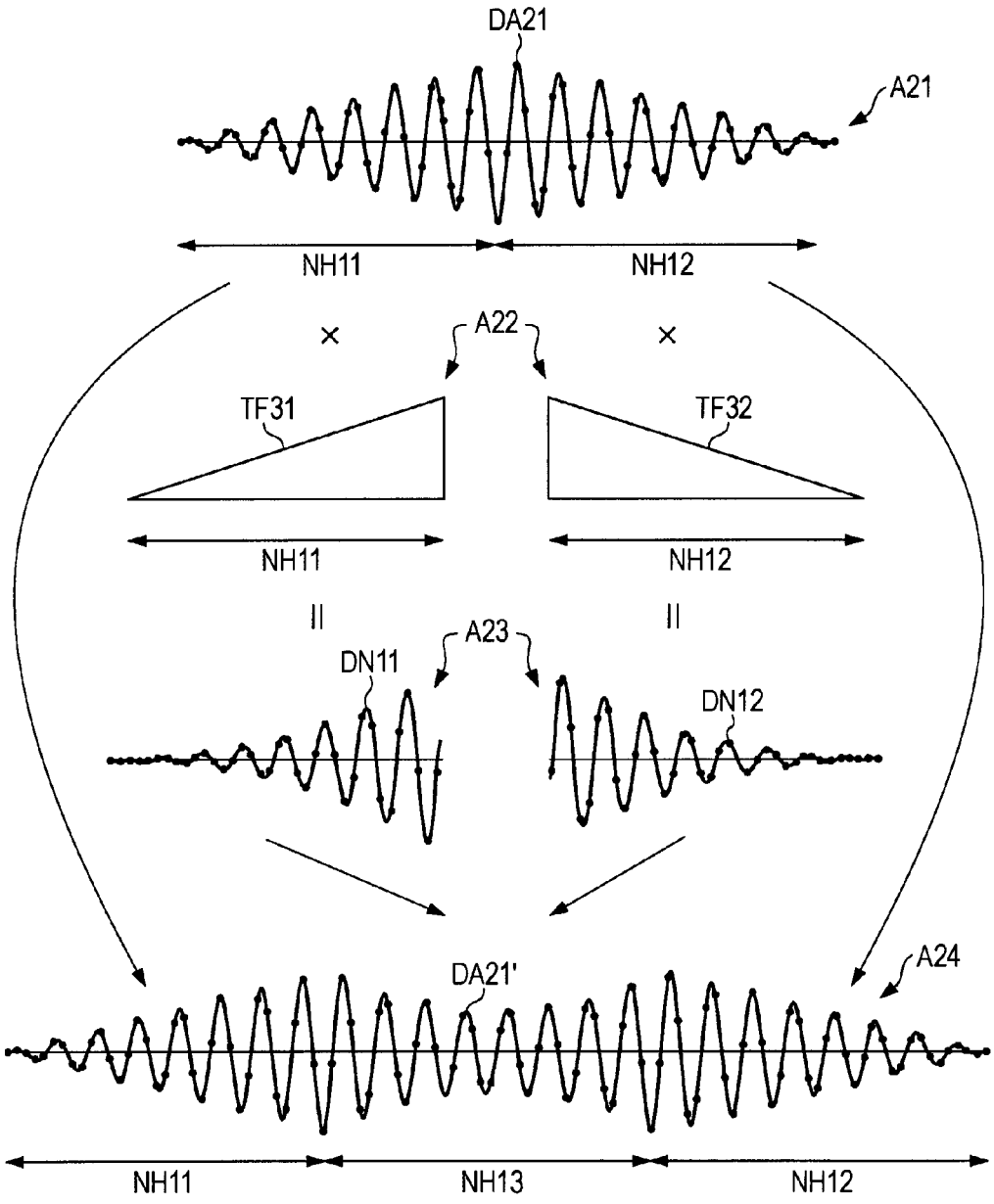
FIG. 13 is a diagram illustrating the overlap process.

Furthermore, for example, in a case where the error ER is a negative value and the triangular window is used in the overlap process, as shown in FIG. 13, the voice signal DA21 is expanded in the time direction. In addition, in FIG. 13, the horizontal direction represents a time, and the vertical direction represents a magnitude of a signal or a value of a function. In addition, in the drawing, circles on a waveform of the voice signal represent samples.

In FIG. 13, as indicated by an arrow A21, it is assumed that the voice signal DA21 is supplied from the time expansion and contraction processing unit 25 to the overlap processing unit 151. In addition, it is assumed that the overlap processing unit 151 expands a section including a section NH11 and a section NH12 of the voice signal DA21 to a section with 3/2 times the number of the samples. In addition, the section NH11 and the section NH12 are sections with a length of the window frame length, which include N successive samples of the voice signal DA21.

In this case, the window framing by a triangular window TF31 and a triangular window TF32 is performed with respect to the section NH11 and the section NH12 of the voice signal DA21, as indicated by an arrow A22.

Here, the triangular window TF31 is a window function indicating a weight that is multiplied to each sample in the section NH11, and the magnitude of the weight becomes large, as it goes toward a weight multiplied to a sample within the section NH11, which is located at a right side in the drawing. The magnitude of the weight of the triangular window TF31 linearly increases in a time direction (in a future direction).

In addition, a triangular window TF32 is a window function indicating a weight that is multiplied to each sample in the section NH12, and the magnitude of the weight becomes small, as it goes toward a weight multiplied to a sample within the section NH12, which is located at a right side in the drawing. The magnitude of the weight of the triangular window TF32 linearly decreases in a time direction (in a future direction).

When the window framing using the triangular window TF31 and the triangular window TF32 is performed, a signal DN11 and a signal DN12 that are indicated by an arrow A23 may be obtained. That is, to each sample within the section NH11 of the voice signal DA21, a value of the triangular window TF31, which is located at the same position as the sample, is multiplied as the weight, and thereby the signal DN11 is obtained. Similarly, to each sample within the section NH12 of the voice signal DA21, a value of the triangular window TF32, which is located at the same position as the sample, is multiplied as the weight, and thereby the signal DN12 is obtained.

In addition, samples, which are located at the same position, of the signal DN11 and the signal DN12 are added to each other, and a signal obtained as a result thereof is inserted between the section NH11 and the section NH12 in the voice signal DA21 as indicated by an arrow A24, and thereby a voice signal DA21' after the expansion is obtained. In this voice signal DA21', a section NH13 including N samples is inserted between the section NH11 and the section NH12, and the section NH13 is a section that is composed of a signal that can be obtained by synthesizing the signal DN11 and the signal DN12.

In this manner, when the newly generated signal (section NH13) is inserted to the voice signal DA21, a section having 2N samples is converted into a section having 3N samples, and thereby the voice signal may be expanded as much as the N samples (error ER).

Figure 14:
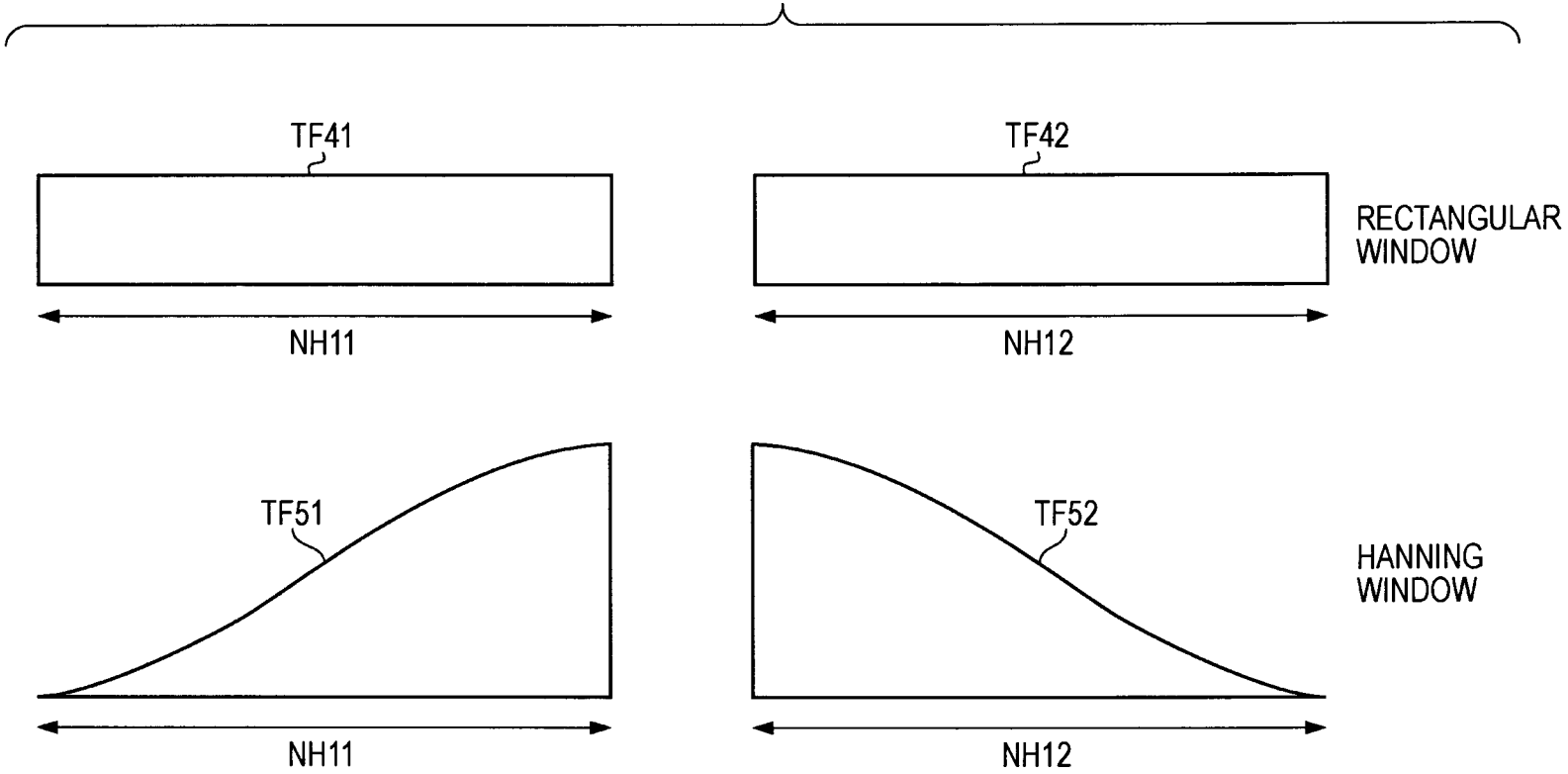
FIG. 14 is a diagram illustrating an example of the window function.

In addition, in the case of expanding the voice signal DA21, for example, a window shown in FIG. 14 may be used. That is, as shown at an upper side in the drawing, a window framing by a rectangular window TF41 and a rectangular window TF42 may be performed with respect to the section NH11 and the section NH12 of the voice signal DA21. Here, the rectangular window TF41 and the rectangular window TF42 are window functions in which a weight multiplied to each sample has the same value in each case.

In addition, as shown at a lower side in the drawing, a window framing by a hanning window TF51 and a hanning window TF52 may be performed with respect to the section NH11 and the section NH12 of the voice signal DA21.

Here, the hanning window TF51 is a window function that represents a weight that is multiplied to each sample within the section NH11, and a magnitude of the weight increases, as it goes toward a weight multiplied to a sample located at a future direction side within the section NH11. In addition, the hanning window TF52 is a window function that represents a weight that is multiplied to each sample within the section NH12, and a magnitude of the weight decreases, as it goes toward a weight multiplied to a sample located at a future direction side within the section NH12. In addition, a value (weight) of the hanning window TF51 and the hanning window TF52 non-linearly varies in the time direction.

As described above, when the overlap process is performed, the number of samples of the voice signal is made to increase or decrease, and thereby the number of samples of the output voice signal may be the number of samples that is expected.

When the output voice signal is generated, the overlap processing unit 151 supplies the generated output voice signal to the error detecting unit 22, and outputs the output voice signal to a reproduction unit or the like that is located at a subsequent stage.

Figure 10:
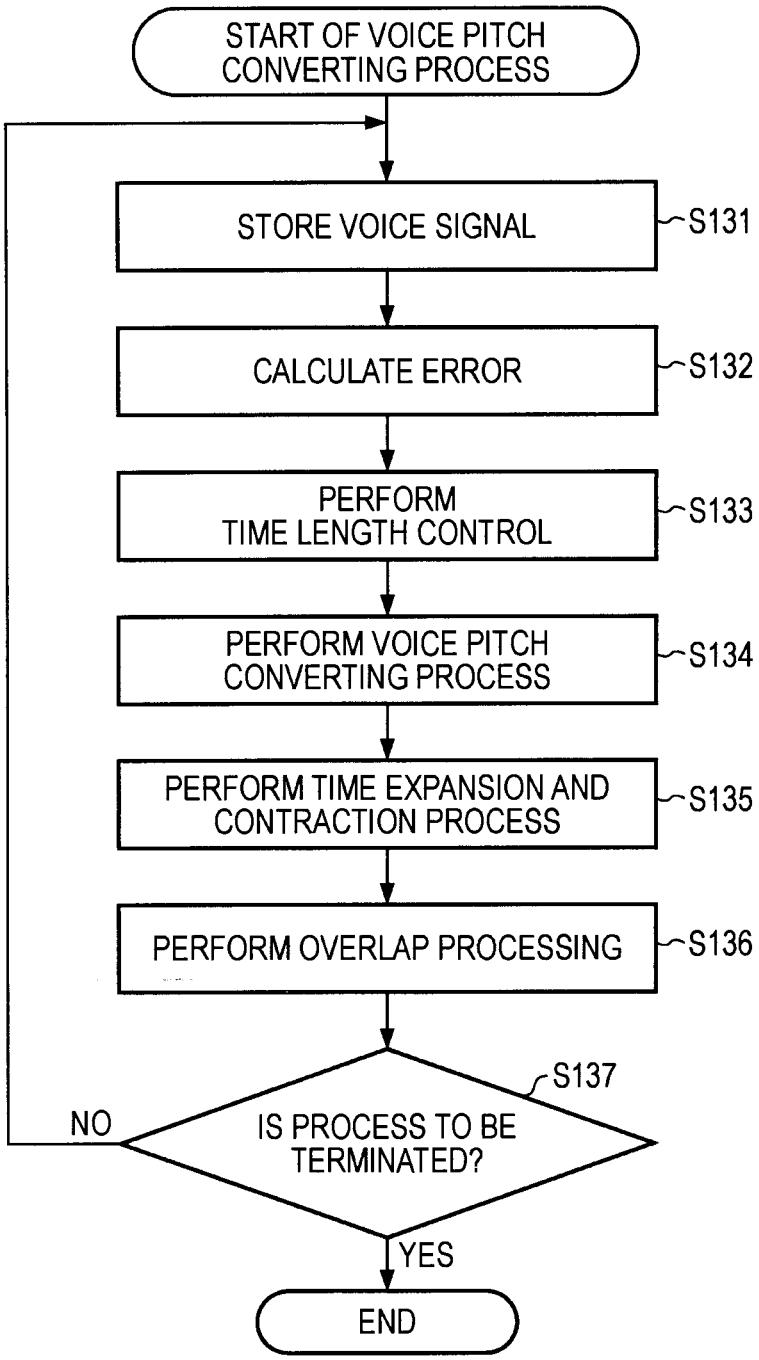
FIG. 10 is a flowchart illustrating the voice pitch converting process.

Returning to description of the flowchart in FIG. 10, a process in step S137 is performed after a process in step S136 is performed, and then the voice pitch converting process is terminated, but the process in step S137 is the same as that in step S17 of FIG. 2, such that description thereof will be omitted.

As described above, the voice pitch converting device 141 calculates the error between the number of samples of the output voice signal, which is expected to be output, and the number of samples of the output voice signal, which is actually output, and then performs the overlap process to the voice signal in response to the error, and thereby the number of samples of the voice signal is made to increase or decrease. Therefore, the number of samples of the output voice signal may become the number of samples that is expected, and thereby the variation in the expansion and contraction of the output voice may be suppressed.

Third Modification

Configuration Example of Voice Pitch Converting Device

Figure 15:
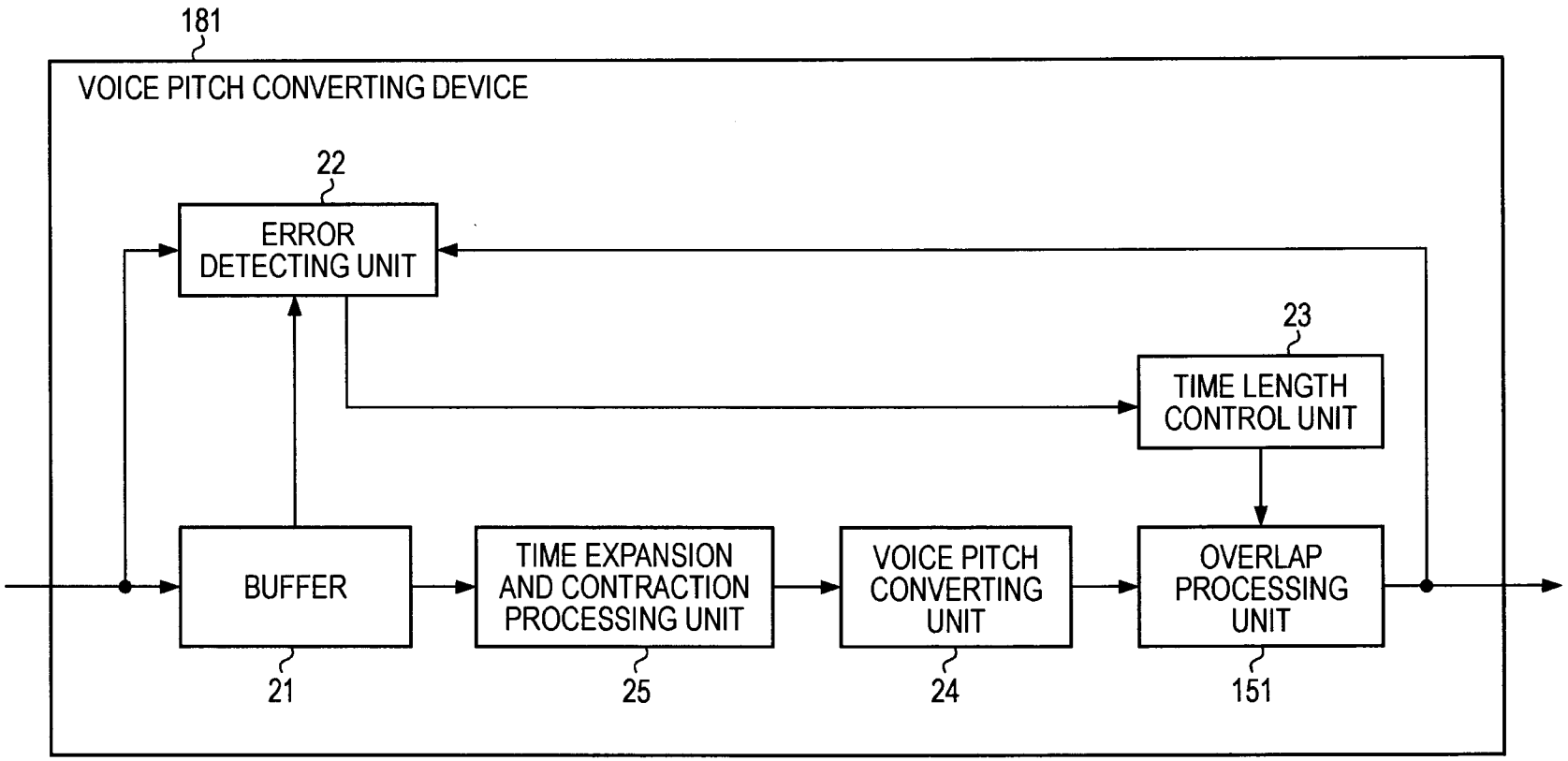
FIG. 15 is a diagram illustrating still another configuration example of the voice pitch converting device.

In addition, in the case of performing the overlap process in response to the error ER, the voice pitch converting process may be performed after the time expansion and contraction process. In this case, the voice pitch converting device may be configured, for example, as shown in FIG. 15. In addition, in FIG. 15, like reference numerals will be given to parts corresponding to those in the case of FIG. 9, and description thereof will be appropriately omitted.

A voice pitch converting device 181 in FIG. 15 and the voice pitch converting device 141 in FIG. 9 are different from each other in that a connection relationship between the voice pitch converting unit 24 and the time expansion and contraction processing unit 25 is reversed, and the other configurations are the same as each other. That is, in the voice pitch converting device 181, the time expansion and contraction processing unit 25 performs the time expansion and contraction process with respect to the voice signal read out from the buffer 21, and the voice pitch converting unit 24 performs the voice pitch converting process with respect to the voice signal supplied from the time expansion and contraction processing unit 25, and supplies the resultant voice signal to an overlap processing unit 151.

Description of Voice Pitch Converting Process

Figure 16:
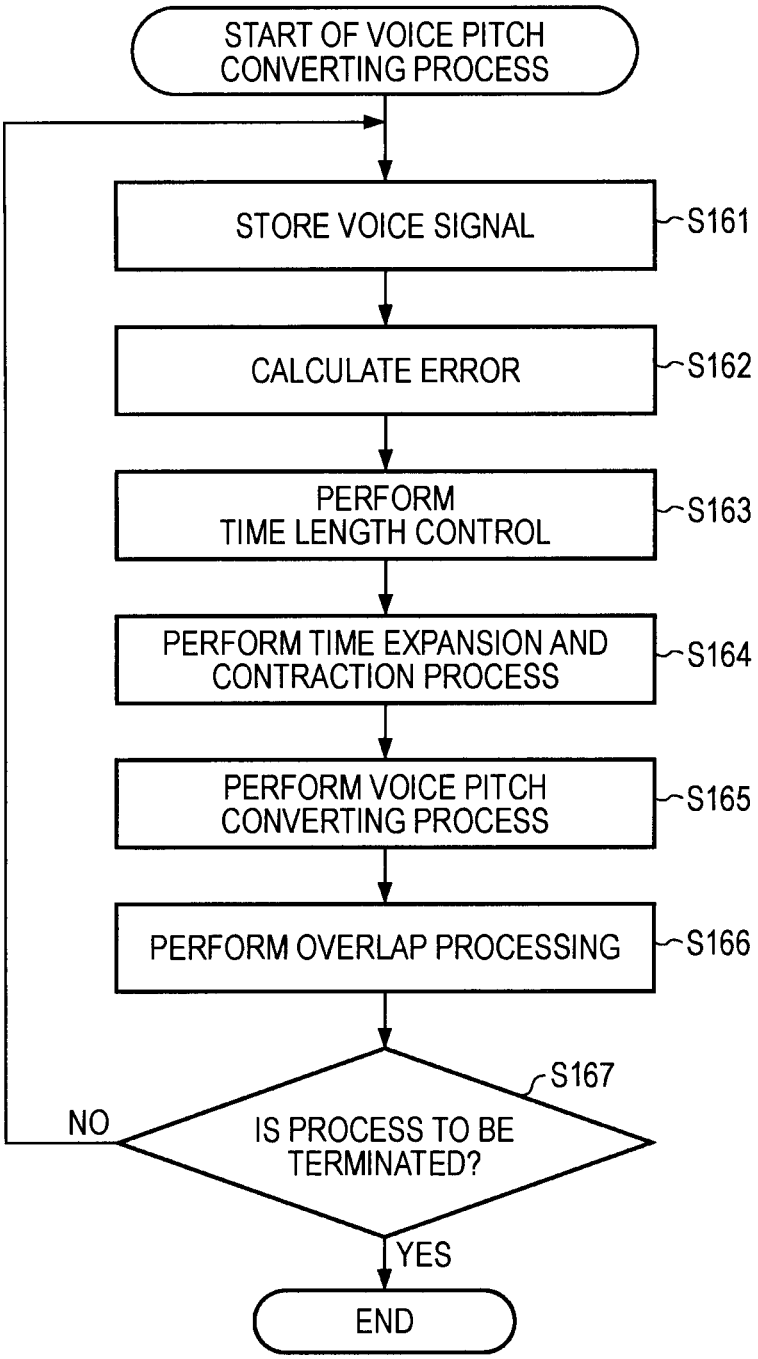
FIG. 16 is a flowchart illustrating the voice pitch converting process.

Next, the voice pitch converting process performed by the voice pitch converting device 181 in FIG. 15 will be described with reference a flowchart in FIG. 16. In addition, the processes in step S161 to step S163 are the same as those in step S131 to step S133 in FIG. 10, such that description thereof will be omitted.

In step S164, the time expansion and contraction processing unit 25 reads out the voice signal from the buffer 21 and performs the time expansion and contraction process, and then supplies the resultant voice signal to the voice pitch converting unit 24. In step S165, the voice pitch converting unit 24 performs the voice pitch converting process with respect to the voice signal supplied from the time expansion and contraction processing unit 25, and supplies the resultant voice signal to the overlap processing unit 151. In addition, in step S164 and step S165, the same processes as those in step S135 and step S134 in FIG. 10 are performed.

Processes in step S166 and step S167 are performed after the process in step S165 is performed, and then the voice pitch converting process is terminated, but these processes are the same as those in step S136 and step S137 of FIG. 10, such that description thereof will be omitted.

In this manner, even when the voice pitch converting process is performed after the time expansion and contraction process, the variation in the expansion and contraction of the output voice may be suppressed.

Fourth Embodiment

Configuration Example of Voice Pitch Converting Device

In addition, description has been made with respect to an example in which the correction by the amount of the error ER is performed by the overlap process by the window framing, but the time expansion and contraction ratio in the time expansion and contraction process may be corrected by the amount of the error ER.

Figure 17:
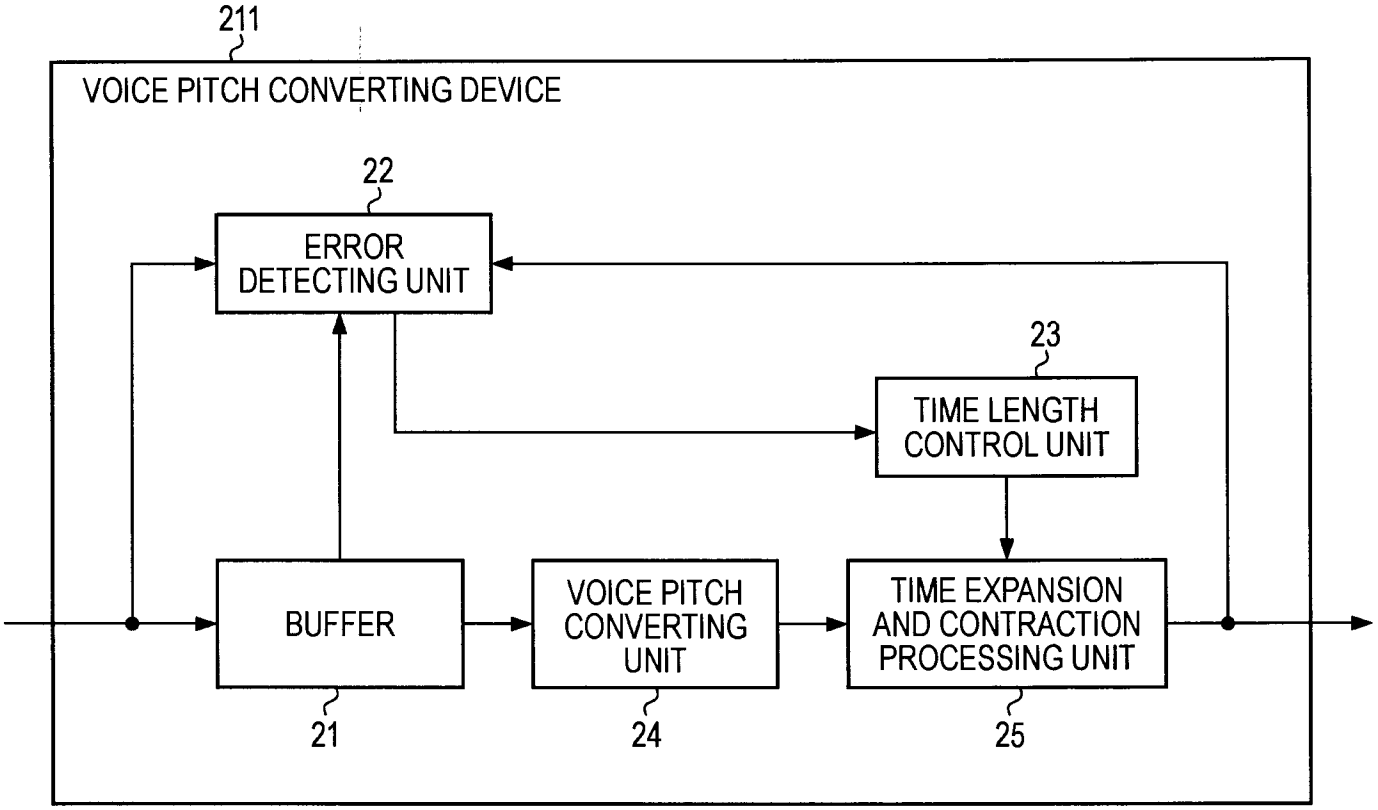
FIG. 17 is a diagram illustrating still another configuration example of the voice pitch converting device.

In this case, the voice pitch converting device may be configured, for example, as shown in FIG. 17. In addition, in FIG. 17, like reference numerals will be given to parts corresponding to those in the case of FIG. 1, and description thereof will be appropriately omitted. A voice pitch converting device 211 in FIG. 17 and the voice pitch converting device 11 in FIG. 1 are different from each other in that the voice pitch converting device 211 is not provided with the thinning and inserting unit 26, and the other configurations are the same as each other.

That is, in the voice pitch converting device 211, the time length control unit 23 performs a control with respect to the time expansion and contraction process that is performed by the time expansion and contraction processing unit 25. The time expansion and contraction processing unit 25 performs the time expansion and contraction process with respect to the voice signal supplied from the voice pitch converting unit 24 with a time expansion and contraction ratio to which the error ER is added, according to the control of the time length control unit 23, and thereby expands or contracts the time length of the voice signal. The time expansion and contraction processing unit 25 outputs the output voice signal that can be obtained by the time expansion and contraction process to the error detecting unit 22 and a subsequent stage (not shown).

Description of Voice Pitch Converting Process

Next, the voice pitch converting process performed by the voice pitch converting device 211 will be described with reference a flowchart in FIG. 18. In addition, the processes in step S191 to step S194 are the same as those in step S11 to step S14 in FIG. 2, such that description thereof will be omitted.

In step S195, the time expansion and contraction processing unit 25 performs the time expansion and contraction process, for example, the PICOLA, a phase vocoder, or the like with respect to the voice signal that is supplied from the voice pitch converting unit 24, according to a control of the time length control unit 23.

At this time, the time expansion and contraction processing unit 25 obtains the reciprocal of the time expansion and contraction ratio of the voice signal, which is changed by the voice pitch converting process performed by the voice pitch converting unit 24, as a time expansion and contraction ratio in the time expansion and contraction process. In addition, the time expansion and contraction processing unit 25 makes the obtained time expansion and contraction ratio increase or decrease in response to the error ER, and then sets the resultant value as an ultimate time expansion and contraction ratio.

For example, in a case where the error ER is a positive value, the time expansion and contraction processing unit 25 decreases the time expansion and contraction ratio in such a manner that the time length of the voice signal is shortened by the amount of the error ER, and in a case where the error ER is a negative value, the time expansion and contraction processing unit 25 increases the time expansion and contraction ratio in such a manner that the time length of the voice signal is lengthened by the amount of the error ER.

In this manner, when the time expansion and contraction ratio that is corrected by the amount of the error ER is obtained, the time expansion and contraction processing unit 25 performs the time expansion and contraction process with the obtained time expansion and contraction ratio with respect to the voice signal, and thereby adjusts the time length of the voice signal. The voice signal in which the time length is adjusted by the time expansion and contraction process is set as the output voice signal. In this manner, when the time expansion and contraction ratio is corrected by the amount of the error ER, and the time expansion and contraction process is performed, the number of the samples of the voice signal is increased or decreased, and thereby the number of samples of the output voice signal may become the number of samples that is expected.

When the output voice signal is generated, the time expansion and contraction processing unit 25 supplies the generated output voice signal to the error detecting unit 22 and outputs the output voice signal to a reproduction unit or the like, which is located at a subsequent stage.

A process in step S196 is performed after the process in step S195 is performed, and then the voice pitch converting process is terminated, but the process in step S196 is the same as that in step S17 of FIG. 2, such that description thereof will be omitted.

In this manner, the voice pitch converting device 211 calculates the error between the number of samples of the output voice signal, which is expected to be output, and the number of samples of the output voice signal, which is actually output, and performs the time expansion and contraction process with respect to the voice signal in response to the error, and thereby increases or decreases the number of samples of the voice signal. As a result, the number of samples of the output voice signal may become the expected number of samples, and thereby the variation in the expansion and contraction of the output voice may be suppressed.

Fourth Modification

Configuration Example of Voice Pitch Converting Device

Figure 19:
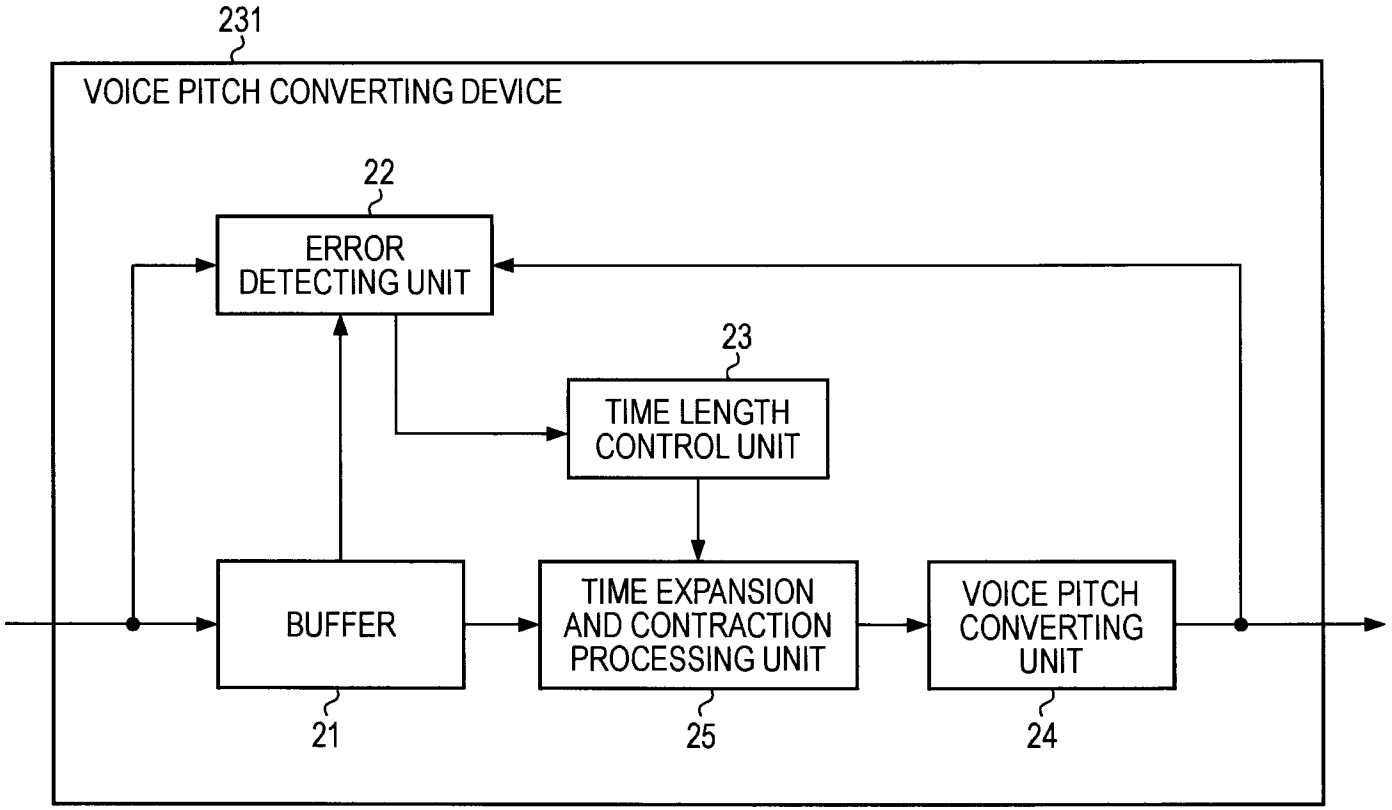
FIG. 19 is a diagram illustrating still another configuration example of the voice pitch converting device.

In addition, even in the case of performing the time expansion and contraction process in response to the error ER, the voice pitch converting process may be performed after the time expansion and contraction process. In this case, the voice pitch converting device may be configured, for example, as shown in FIG. 19. In addition, in FIG. 19, like reference numerals will be given to parts corresponding to those in the case of FIG. 17, and description thereof will be appropriately omitted.

A voice pitch converting device 231 in FIG. 19 and the voice pitch converting device 211 in FIG. 17 are different from each other in that a connection relationship between the voice pitch converting unit 24 and the time expansion and contraction processing unit 25 is reversed, and the other configurations are the same as each other. That is, in the voice pitch converting device 231, the time expansion and contraction processing unit 25 performs the time expansion and contraction process with respect to the voice signal read out from the buffer 21, and the voice pitch converting unit 24 performs the voice pitch converting process with respect to the voice signal supplied from the time expansion and contraction processing unit 25, and generates the output voice signal.

Description of Voice Pitch Converting Process

Figure 20:
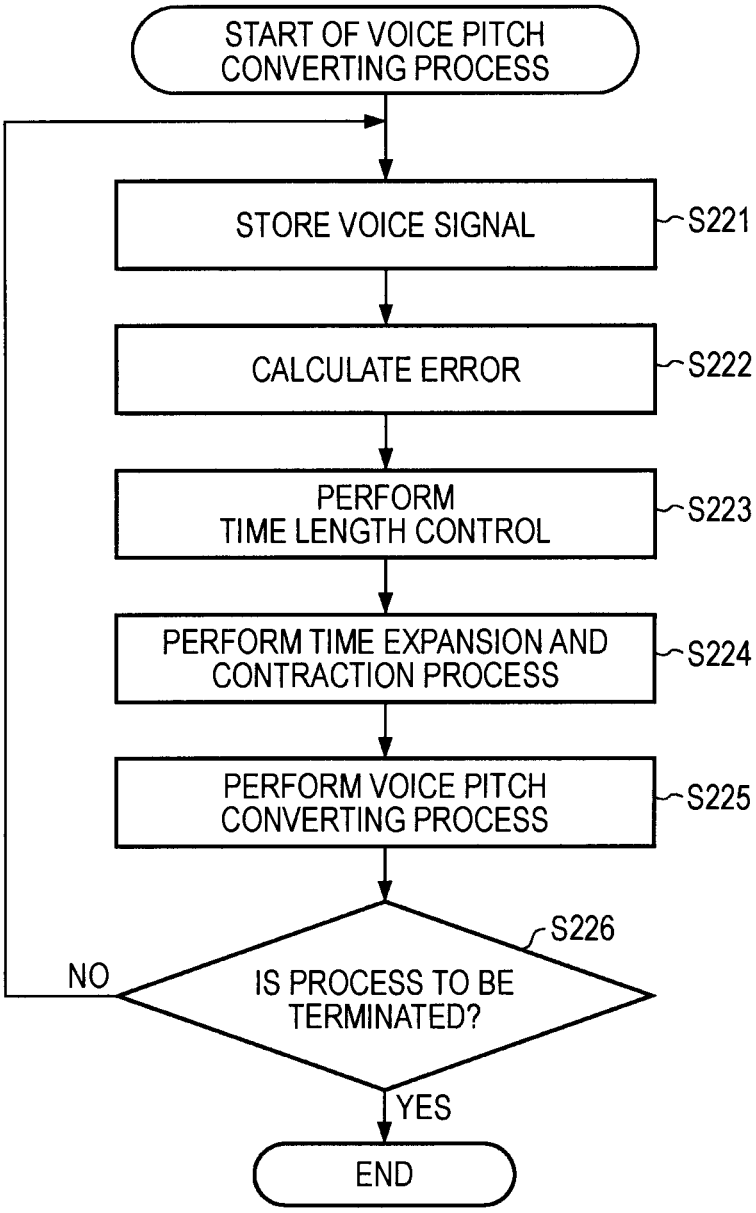
FIG. 20 is a flowchart illustrating the voice pitch converting process.

Next, the voice pitch converting process performed by the voice pitch converting device 231 in FIG. 19 will be described with reference a flowchart in FIG. 20. In addition, the processes in step S221 to step S223 are the same as those in step S191 to step S193 in FIG. 18, such that description thereof will be omitted.

In step S224, the time expansion and contraction processing unit 25 reads out the voice signal from the buffer 21 and performs the time expansion and contraction process, according to a control of the time length control unit 23, and then supplies the resultant voice signal to the voice pitch converting unit 24. In step S225, the voice pitch converting unit 24 performs the voice pitch converting process with respect to the voice signal supplied from the time expansion and contraction processing unit 25, and generates the output voice signal.

When the output voice signal is generated, the voice pitch converting unit 24 supplies the generated output voice signal to the error detecting unit 22 and outputs the output voice signal to a reproduction unit or the like, which is located at a subsequent stage. In addition, in step S224 and step S225, the same processes as those in step S195 and step S194 in FIG. 18 are performed.

Figure 18:
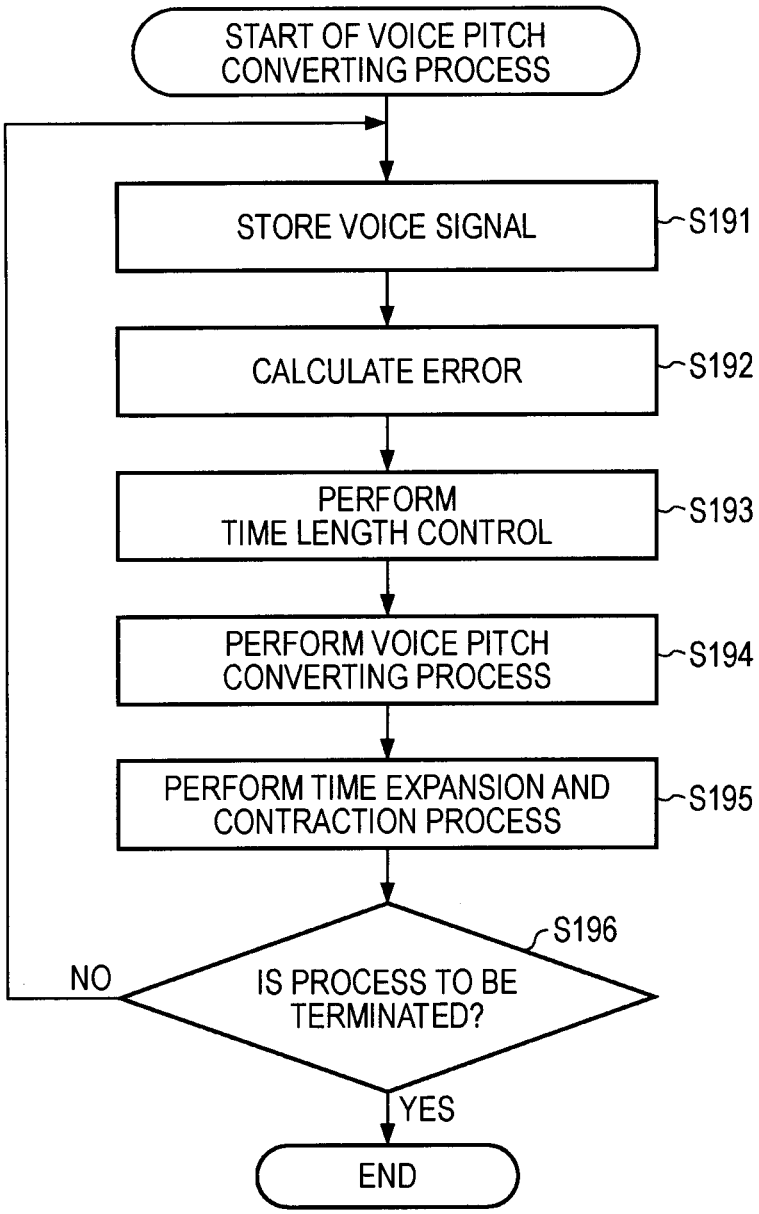
FIG. 18 is a flowchart illustrating the voice pitch converting process.

A process in step S226 is performed after the process in step S225 is performed, and then the voice pitch converting process is terminated, but this process in step S226 is the same as that in step S196 of FIG. 18, such that description thereof will be omitted.

In this manner, even when the voice pitch converting process is performed after the time expansion and contraction process, the variation in the expansion and contraction of the output voice may be suppressed.

The above-described series of processes may be executed by hardware or software. In a case where the above-described series of processes is executed by the software, a program making up the software may be installed, from a program recording medium, on a computer in which dedicated hardware is assembled, or for example, a general purpose personal computer or the like that can execute various functions by installing various programs.

Figure 21:
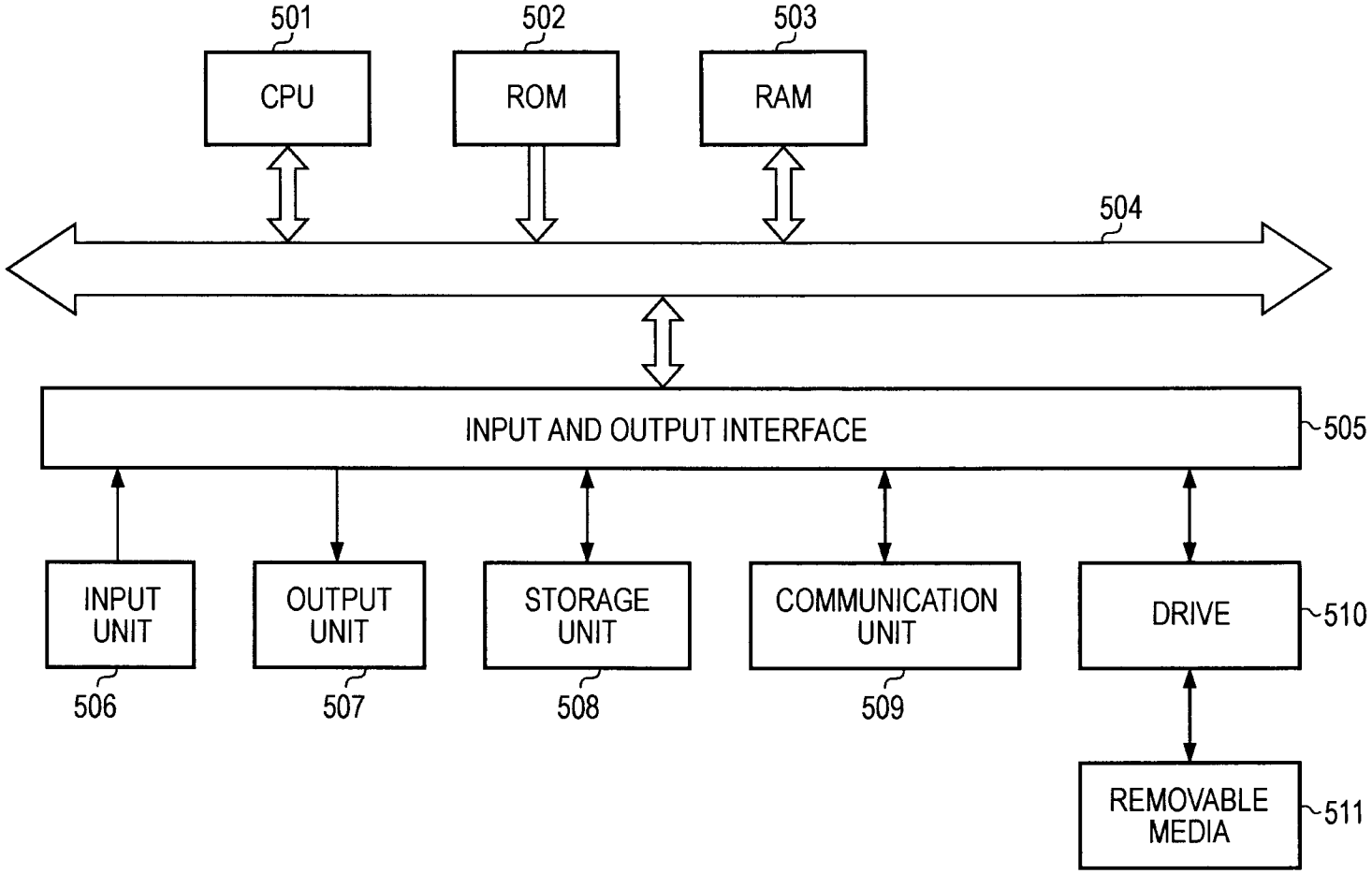
FIG. 21 is a diagram illustrating a configuration example of a computer.

FIG. 21 shows a block diagram illustrating a configuration example of computer hardware that performs the above-described serial processes by program.

In regard to a computer, a CPU (Central Processing Unit) 501, a ROM (Read Only Memory) 502, and a RAM (Random Access memory) 503 are connected with each other by a bus 504.

To the bus 504, an input and output interface 505 is further connected. An input unit 506 such as a keyboard, a mouse, and a microphone, an output unit 507 such as a display and a speaker, a recording unit 508 such as a hard disk and a non-volatile memory, a communication unit 509 such as a network interface, and a drive 510 that drives a removable medium 511 such as a magnetic disk, an optical disc, a magneto-optical disc, and a semiconductor memory are connected to the input and output interface 505.

In the computer configured as described above, the CPU 501 performs such serial processes described above by loading, for example, a program stored in the recording unit 508 through the input and output interface 505 and the bus 504 to the RAM 503 and executing the program.

The program executed by the computer (CPU 501) may be supplied by being recorded on a removable medium 511 that is a package medium such as a magnetic disk (including a flexible disk), an optical disc (for example, CD-ROM (Compact Disc-Read Only Memory), DVD (Digital Versatile Disc) or the like), a magneto-optical disc, and a semiconductor memory, or may be supplied through a wired or wireless transmission medium such a local area network, the Internet, and digital broadcasting.

The program may be installed in the recording unit 508 through the input and output interface 505 by mounting the removable medium 511 in the drive 510. In addition, the program may be received by the communication unit 509 through a wired or wireless transmission medium and may be installed in the recording medium 508. In other cases, the program may be installed in the ROM 502 or the recording unit 508 in advance.

In addition, the program executed by the computer may be a program that performs the processes in time series according to a sequence described in this specification, or a program that performs the processes in parallel or at a necessary timing such as when being called.

The present disclosure contains subject matter related to that disclosed in Japanese Priority Patent Application JP 2011-058956 filed in the Japan Patent Office on Mar. 17, 2011, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A voice processing device, comprising:

at least one processor;

a voice pitch converting unit that performs a voice pitch converting process with respect to an input voice signal and converts voice pitch of the input voice signal using the at least one processor;

an error detecting unit that detects an error between the number of samples of an output voice signal, which is expected, and the number of samples of the output voice signal, which is actually output using the at least one processor; and a time length control unit that controls an adjustment of a time length in such a manner that the time length of the output voice signal is corrected by the amount of the error using the at least one processor.

2. The voice processing device according to claim 1 wherein the error detecting unit detects the error based on the number of samples of the input voice signal, the number of samples of the output voice signal, which is output, and the number of non-processed samples of the input voice signal.

3. The voice processing device according to claim 1, further comprising:

a time expansion and contraction processing unit that performs a time expansion and contraction process with respect to the input voice signal, and adjusts the time length of the input voice signal using the at least one processor.

4. The voice processing device according to claim 1, further comprising:

a thinning and inserting unit that performs sample thinning or insertion with respect to the input voice signal to which the voice pitch converting process is performed, according to the control of the time length control unit, and adjusts the time length using the at least one processor.

5. The voice processing device according to claim 1, further comprising:

a converting unit that performs a sampling rate conversion with respect to the input voice signal to which the voice pitch converting process is performed, according to the control of the time length control unit, and adjusts the time length using the at least one processor.

6. The voice processing device according to claim 1, further comprising:

an overlap processing unit that performs an overlap process using a window with a length determined by the error with respect to the input voice signal to which the voice pitch converting process is performed, according to the control of the time length control unit, and adjusts the time length using the at least one processor.

7. The voice processing device according to claim 1, further comprising:

a time expansion and contraction processing unit that performs a time expansion and contraction process with respect to the input voice signal with a time expansion and contraction ratio determined by the error, according to the control of the time length control unit, and adjusts the time length using the at least one processor.

8. A voice processing method of a voice processing device including a voice pitch converting unit that performs a voice pitch converting process with respect to an input voice signal and converts voice pitch of the input voice signal, an error detecting unit that detects an error between the number of samples of an output voice signal, which is expected, and the number of samples of the output voice signal, which is actually output, and a time length control unit that controls an adjustment of a time length in such a manner that the time length of the output voice signal is corrected by the amount of the error, the method comprising:

performing the voice pitch converting process with respect to the input voice signal using the voice pitch converting unit;

detecting the error using the error detecting unit; and controlling the adjustment of the time length using the time length control unit.

9. A non-transitory computer-readable medium having embodied thereon a program, which when executed by a processor of a computer causes the processor to execute a process including:

performing a voice pitch converting process with respect to an input voice signal and converting voice pitch of the input voice signal;

detecting an error between the number of samples of an output voice signal, which is expected, and the number of samples of the output voice signal, which is actually output; and controlling an adjustment of a time length in such a manner that the time length of the output voice signal is corrected by the amount of the error.

* * * * *